US012478185B2

(12) United States Patent
Rains et al.

(10) Patent No.: US 12,478,185 B2
(45) Date of Patent: Nov. 25, 2025

(54) RECLINING CHAISE MECHANISM

(71) Applicant: La-Z-Boy Incorporated, Monroe, MI (US)

(72) Inventors: Jason D. Rains, Evensville, TN (US); Larry P. LaPointe, Temperance, MI (US); Jaime A. McPherson, Signal Mountain, TN (US); Ryan M. Nowicki, Chattanooga, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 197 days.

(21) Appl. No.: 18/121,112

(22) Filed: Mar. 14, 2023

(65) Prior Publication Data

US 2023/0292922 A1 Sep. 21, 2023

Related U.S. Application Data

(60) Provisional application No. 63/321,502, filed on Mar. 18, 2022.

(51) Int. Cl.
*A47C 1/024* (2006.01)
*A47C 1/14* (2006.01)

(52) U.S. Cl.
CPC ..... *A47C 1/0244* (2013.01); *A47C 1/0242* (2013.01); *A47C 1/143* (2013.01)

(58) Field of Classification Search
CPC ..... A47C 1/0244; A47C 1/143
See application file for complete search history.

(56) References Cited

U.S. PATENT DOCUMENTS 203,602 A 5/1878 Dietsch
1,182,854 A 5/1916 Poler
(Continued)

FOREIGN PATENT DOCUMENTS

CA 1316807 C 4/1993
CN 87203587 U 1/1988
(Continued)

OTHER PUBLICATIONS

Chinese Office Action regarding Patent Application No. 201980075907.5, dated Jun. 24, 2024.
(Continued)

*Primary Examiner* — Milton Nelson, Jr.
(74) *Attorney, Agent, or Firm* — Harness, Dickey & Pierce, P.L.C.

(57) ABSTRACT

A furniture member may include a seat bottom frame, a seatback frame, and a reclining mechanism. The seatback frame may be movable relative to the seat bottom frame between an upright position and a reclined position. The seatback frame may be coupled to the seat bottom frame by a pair of linkages. The reclining mechanism may include a front support member and a rear support member. The front support member may be attached to the seat bottom frame and the rear support member may be attached to the linkages. The rear support member may be movable relative to the seat bottom frame between a first position when the seatback frame is in the upright position and a second position when the seatback frame is in the reclined position. Movement of the seatback frame between the upright position and the reclined position causes movement of the rear support member.

18 Claims, 20 Drawing Sheets

(56) References Cited

U.S. PATENT DOCUMENTS 1,414,637 A 5/1922 Gell
2,473,895 A 6/1949 Mednick
2,677,412 A 5/1954 Thomas
2,719,572 A 10/1955 Goldberg
2,772,723 A 12/1956 Tunnell
3,096,121 A 7/1963 Knabusch et al.
3,179,466 A 4/1965 Garrett
3,191,990 A 6/1965 Rugg et al.
3,302,969 A 2/1967 Mizelle et al.
3,339,971 A 9/1967 Fletcher
3,352,601 A 11/1967 Cycowicz
3,567,280 A 3/1971 Bradshaw
3,637,255 A 1/1972 Re
3,638,995 A 2/1972 Flanagan et al.
3,758,151 A 9/1973 Re
3,815,954 A 6/1974 Rogers, Jr. et al.
3,865,432 A 2/1975 Rogers, Jr. et al.
3,880,462 A 4/1975 Mednick
3,926,472 A 12/1975 Evans
3,941,417 A 3/1976 Re
3,945,449 A 3/1976 Ostrow
4,077,663 A 3/1978 Cycowicz et al.
4,099,776 A 7/1978 Crum et al.
4,140,342 A 2/1979 Jones
4,179,157 A 12/1979 Shoemaker et al.
4,191,420 A 3/1980 Fassett et al.
4,212,494 A 7/1980 Dabney
4,212,495 A 7/1980 Gall
4,216,991 A 8/1980 Holobaugh
4,216,992 A 8/1980 Crum
4,226,468 A 10/1980 Johnson
4,226,473 A 10/1980 Johnson
4,244,620 A 1/1981 Harrison et al.
4,352,523 A 10/1982 Holobaugh, Jr.
4,364,603 A 12/1982 Johnson
4,367,895 A 1/1983 Pacitti et al.
4,373,602 A 2/1983 Tomita et al.
4,451,084 A 5/1984 Seeley
4,492,407 A 1/1985 Broadhead
4,519,647 A 5/1985 Rogers, Jr.
4,570,995 A 2/1986 Rogers, Jr.
4,570,996 A 2/1986 Rogers, Jr.
4,582,435 A 4/1986 Davis
4,586,749 A 5/1986 Nakatani
4,601,513 A 7/1986 Pine
4,650,211 A 3/1987 Tanahashi
4,662,597 A 5/1987 Uecker et al.
4,719,764 A 1/1988 Cook
4,740,031 A 4/1988 Rogers, Jr.
4,805,960 A 2/1989 Tacker
4,818,018 A 4/1989 Yamasaki
4,861,101 A 8/1989 Hartline
4,895,411 A 1/1990 Pine
4,915,444 A 4/1990 Rogers, Jr.
4,932,927 A 6/1990 Fillar
4,989,914 A 2/1991 Pine
5,011,220 A 4/1991 LaPointe
5,044,692 A 9/1991 Tidwell, Jr. et al.
5,054,850 A 10/1991 Pine
5,064,244 A 11/1991 Sproule
5,072,988 A 12/1991 Plunk
5,088,789 A 2/1992 LaPointe et al.
5,123,705 A 6/1992 Johnson
5,129,701 A 7/1992 Pine
5,141,284 A 8/1992 LaPointe
5,147,108 A 9/1992 LaPointe
5,156,441 A 10/1992 Byersmith et al.
5,171,000 A 12/1992 LaPointe et al.
5,217,276 A 6/1993 LaPointe et al.
5,217,277 A 6/1993 Rasnick et al.
5,234,253 A 8/1993 LaPointe et al.
5,238,295 A 8/1993 Harrell
5,271,660 A 12/1993 LaPointe et al.
5,312,153 A 5/1994 Lin
5,323,526 A 6/1994 Saul et al.
5,328,235 A 7/1994 Saul et al.
5,348,367 A 9/1994 Mizelle
5,360,255 A 11/1994 Cook et al.
5,423,591 A 6/1995 LaPointe et al.
5,435,621 A 7/1995 Komorowski et al.
5,435,622 A 7/1995 Fay et al.
5,466,046 A 11/1995 Komorowski et al.
5,480,209 A 1/1996 May
5,480,213 A 1/1996 Sproule
5,503,453 A 4/1996 Saul et al.
5,527,095 A 6/1996 Marshall et al.
5,567,009 A 10/1996 Fay et al.
5,570,927 A 11/1996 LaPointe et al.
5,570,930 A 11/1996 LaPointe et al.
5,582,457 A 12/1996 Komorowski et al.
5,597,209 A 1/1997 Bart et al.
5,664,832 A 9/1997 Stevens et al.
5,730,494 A 3/1998 LaPointe et al.
5,765,913 A 6/1998 LaPointe et al.
5,772,278 A 6/1998 Kowalski
5,775,775 A 7/1998 Hoffman
5,806,920 A 9/1998 Blount
5,806,921 A 9/1998 LaPointe et al.
5,823,614 A 10/1998 Johnson et al.
5,838,808 A 11/1998 Prosser
5,857,739 A 1/1999 Smith
5,865,457 A 2/1999 Knabusch et al.
5,954,392 A 9/1999 Liss et al.
5,971,475 A 10/1999 Lawson et al.
5,975,627 A 11/1999 LaPointe et al.
5,992,930 A 11/1999 LaPointe et al.
6,000,754 A 12/1999 Lawson
6,030,033 A 2/2000 Schultz
6,106,058 A 8/2000 Sur et al.
6,145,924 A 11/2000 Mero, Jr. et al.
6,179,328 B1 1/2001 Kawagoe et al.
6,227,489 B1 5/2001 Kitamoto et al.
6,231,120 B1 5/2001 Wiecek
6,276,753 B1 8/2001 Sur et al.
6,309,015 B1 10/2001 Pine
6,330,995 B1 12/2001 Mangeiga et al.
6,409,262 B1 6/2002 LaPointe
6,467,845 B1 10/2002 Chen
6,488,332 B1 12/2002 Markwald
6,491,342 B1 12/2002 Smith
6,655,732 B1 12/2003 LaPointe
6,827,401 B2 12/2004 Marshall et al.
6,939,076 B2 9/2005 LaPointe
6,988,769 B2 1/2006 LaPointe
7,261,367 B2 8/2007 Duncan et al.
7,275,789 B2 10/2007 LaPointe
7,311,359 B2 12/2007 Smith
7,338,132 B2 3/2008 LaPointe
7,357,450 B2 4/2008 Rogers
7,431,387 B2 10/2008 LaPointe et al.
7,431,392 B2 10/2008 Tamara
7,475,944 B2 1/2009 Griepentrog et al.
7,552,970 B2 6/2009 LaPointe
7,585,018 B2 9/2009 LaPointe et al.
7,637,571 B2 12/2009 Okano et al.
7,673,933 B2 3/2010 Lawson
7,708,346 B2 * 5/2010 White ..... A47C 1/0244
297/362.12
7,731,276 B2 6/2010 Hoffman et al.
7,823,966 B2 11/2010 Buchholz
7,828,380 B2 11/2010 Olarte
7,850,232 B2 12/2010 Casteel
8,132,855 B2 3/2012 Richard
8,308,228 B2 11/2012 Lawson et al.
8,573,687 B2 11/2013 Lawson et al.
8,590,964 B2 11/2013 Murphy et al.
8,616,627 B2 12/2013 Murphy et al.
8,622,467 B2 1/2014 Murphy et al.
8,696,054 B2 4/2014 Crum
9,314,101 B2 4/2016 Harwood et al.
9,357,847 B2 6/2016 Murphy
9,433,295 B2 9/2016 Crum
9,635,943 B2 5/2017 Lawson
9,655,450 B2 5/2017 Marshall et al.

(56) References Cited

U.S. PATENT DOCUMENTS

| | | | |
|---|---|---|---|
| 9,655,451 | B2 | 5/2017 | Harwood et al. |
| 9,808,090 | B2 | 11/2017 | Carrera |
| 9,895,000 | B2 | 2/2018 | Hassman |
| 9,986,832 | B2 | 6/2018 | LaPointe et al. |
| 9,986,835 | B2 | 6/2018 | LaPointe et al. |
| 10,092,106 | B2 | 10/2018 | LaPointe et al. |
| 10,485,347 | B2 | 11/2019 | Lawson et al. |
| 10,492,613 | B2 | 12/2019 | LaPointe et al. |
| 10,512,332 | B2 | 12/2019 | LaPointe et al. |
| 10,512,333 | B2 | 12/2019 | Lawson et al. |
| 10,524,574 | B2 | 1/2020 | LaPointe et al. |
| 10,524,575 | B2 | 1/2020 | LaPointe |
| 10,537,178 | B2 | 1/2020 | Marshall et al. |
| 10,568,428 | B2 | 2/2020 | Marshall et al. |
| 10,653,243 | B2 | 5/2020 | Lawson et al. |
| 10,681,987 | B2 | 6/2020 | Liu et al. |
| 10,709,246 | B2 | 7/2020 | Murphy |
| 10,750,870 | B2 | 8/2020 | Marshall et al. |
| 10,779,653 | B2 | 9/2020 | LaPointe et al. |
| 10,820,708 | B2 | 11/2020 | LaPointe et al. |
| 10,890,235 | B2 | 1/2021 | Bucove |
| 11,197,549 | B1 | 12/2021 | LaPointe et al. |
| 11,490,736 | B1 | 11/2022 | Liu et al. |
| 2001/0026088 | A1 | 10/2001 | Robinson |
| 2003/0057743 | A1 | 3/2003 | May |
| 2004/0000803 | A1 | 1/2004 | Guillot et al. |
| 2005/0035632 | A1 | 2/2005 | Tseng |
| 2005/0067867 | A1 | 3/2005 | May |
| 2006/0061147 | A1 | 3/2006 | Johnson et al. |
| 2006/0103202 | A1 | 5/2006 | Maki et al. |
| 2006/0249992 | A1 | 11/2006 | LaPointe et al. |
| 2006/0249993 | A1 | 11/2006 | Rogers |
| 2007/0040419 | A1 | 2/2007 | LaPointe et al. |
| 2007/0085395 | A1 | 4/2007 | LaPointe |
| 2007/0158980 | A1 | 7/2007 | LaPointe et al. |
| 2007/0241589 | A1 | 10/2007 | LaPointe |
| 2008/0129006 | A1 | 6/2008 | Johnson et al. |
| 2008/0150329 | A1 | 6/2008 | Lawson |
| 2009/0152915 | A1 | 6/2009 | Krasna et al. |
| 2009/0218862 | A1 | 9/2009 | Du et al. |
| 2009/0243368 | A1 | 10/2009 | LaPointe |
| 2009/0284054 | A1 | 11/2009 | Humer et al. |
| 2011/0016627 | A1 | 1/2011 | Blevins et al. |
| 2011/0175426 | A1 | 7/2011 | Lawson |
| 2011/0233972 | A1 | 9/2011 | Weicek |
| 2011/0248544 | A1 | 10/2011 | Adams et al. |
| 2011/0248545 | A1 | 10/2011 | LaPointe et al. |
| 2011/0248547 | A1 | 10/2011 | LaPointe et al. |
| 2011/0304193 | A1 | 12/2011 | Murphy et al. |
| 2012/0112517 | A1 | 5/2012 | Hoffman et al. |
| 2012/0193946 | A1 | 8/2012 | Robertson |
| 2013/0062914 | A1 | 3/2013 | Marshall et al. |
| 2013/0140855 | A1 | 6/2013 | Murphy et al. |
| 2013/0140856 | A1 | 6/2013 | Murphy et al. |
| 2013/0175847 | A1 | 7/2013 | Lawson |
| 2013/0249256 | A1 | 9/2013 | Payne, Jr. et al. |
| 2014/0049079 | A1 | 2/2014 | Lawson et al. |
| 2014/0049084 | A1 | 2/2014 | Lawson et al. |
| 2014/0070585 | A1 | 3/2014 | LaPointe |
| 2014/0103688 | A1 | 4/2014 | Wilson |
| 2014/0246819 | A1 | 9/2014 | Harwood et al. |
| 2014/0312660 | A1 | 10/2014 | Natuzzi et al. |
| 2014/0327282 | A1 | 11/2014 | Crum |
| 2014/0333099 | A1 | 11/2014 | Lu et al. |
| 2014/0368011 | A1 | 12/2014 | LaPointe |
| 2015/0196123 | A1 | 7/2015 | Buehrer |
| 2015/0250320 | A1 | 9/2015 | Arceci et al. |
| 2015/0272329 | A1* | 10/2015 | Lawson ..... A47C 1/0355 297/342 |
| 2015/0282619 | A1 | 10/2015 | Lawson |
| 2016/0058195 | A1 | 3/2016 | Huang et al. |
| 2016/0100686 | A1 | 4/2016 | Regev |
| 2016/0100687 | A1 | 4/2016 | Murphy et al. |
| 2016/0120315 | A1 | 5/2016 | Robertson |
| 2016/0192779 | A1 | 7/2016 | Harwood et al. |
| 2016/0206097 | A1 | 7/2016 | Rivera |
| 2016/0206099 | A1 | 7/2016 | Robertson |
| 2016/0270537 | A1 | 9/2016 | Marshall et al. |
| 2016/0302573 | A1 | 10/2016 | Garland et al. |
| 2016/0325838 | A1 | 11/2016 | Erhel |
| 2016/0376007 | A1 | 12/2016 | Meindlhumer |
| 2017/0013961 | A1 | 1/2017 | LaPointe et al. |
| 2017/0042330 | A1 | 2/2017 | Bruce et al. |
| 2017/0101188 | A1 | 4/2017 | Auge et al. |
| 2017/0150818 | A1 | 6/2017 | Contreras |
| 2017/0347796 | A1 | 12/2017 | LaPointe et al. |
| 2017/0367483 | A1 | 12/2017 | Fecker et al. |
| 2018/0070725 | A1 | 3/2018 | LaPointe et al. |
| 2018/0078039 | A1 | 3/2018 | LaPointe et al. |
| 2018/0206644 | A1 | 7/2018 | Murphy |
| 2018/0228290 | A1 | 8/2018 | Kiwak et al. |
| 2018/0289156 | A1 | 10/2018 | Marshall et al. |
| 2018/0289157 | A1 | 10/2018 | Marshall et al. |
| 2018/0289158 | A1 | 10/2018 | Marshall et al. |
| 2019/0029436 | A1 | 1/2019 | Lin |
| 2019/0082841 | A1 | 3/2019 | LaPointe et al. |
| 2019/0082849 | A1 | 3/2019 | LaPointe et al. |
| 2019/0116981 | A1 | 4/2019 | LaPointe et al. |
| 2019/0290004 | A1 | 9/2019 | Lawson et al. |
| 2019/0313796 | A1 | 10/2019 | LaPointe |
| 2019/0350362 | A1 | 11/2019 | LaPointe et al. |
| 2019/0350368 | A1 | 11/2019 | LaPointe et al. |
| 2019/0380499 | A1 | 12/2019 | Kang |
| 2020/0163458 | A1 | 5/2020 | Murphy |
| 2020/0352333 | A1 | 11/2020 | LaPointe et al. |
| 2021/0022506 | A1 | 1/2021 | Murphy |
| 2021/0100364 | A1 | 4/2021 | Murphy |
| 2021/0169234 | A1 | 6/2021 | Jacobs et al. |
| 2022/0048627 | A1 | 2/2022 | Erhel et al. |
| 2022/0125201 | A1 | 4/2022 | Lapointe et al. |

FOREIGN PATENT DOCUMENTS

| | | | |
|---|---|---|---|
| CN | 2168480 | Y | 6/1994 |
| CN | 200976974 | Y | 11/2007 |
| CN | 104936483 | A | 9/2015 |
| CN | 105208896 | A | 12/2015 |
| CN | 113208347 | A | 8/2021 |
| CN | 113349581 | A | 9/2021 |
| DE | 623960 | C | 1/1936 |
| DE | 4122375 | A1 | 5/1992 |
| DE | 29707946 | U1 | 7/1997 |
| EP | 1504697 | A1 | 2/2005 |
| JP | S53147329 | A | 12/1978 |
| JP | H04259403 | A | 9/1992 |
| JP | H08266370 | A | 10/1996 |
| JP | H1146920 | A | 2/1999 |
| JP | 2001-046167 | A | 2/2001 |
| JP | 2001054443 | A | 2/2001 |
| JP | 2003070583 | A | 3/2003 |
| JP | 2003260097 | A | 9/2003 |
| JP | 2004065507 | A | 3/2004 |
| JP | 3125308 | U | 9/2006 |
| JP | 2008132141 | A | 6/2008 |
| JP | 2012070787 | A | 4/2012 |
| JP | 2013172804 | A | 9/2013 |
| JP | 2014147849 | A | 8/2014 |
| JP | 2015-066194 | A | 4/2015 |
| JP | 3198305 | U | 6/2015 |
| JP | 2021133182 | A | 9/2021 |
| KR | 20060036132 | A | 4/2006 |
| KR | 100807370 | B1 | 2/2008 |
| KR | 101245357 | B1 | 3/2013 |
| TW | 374704 | B | 11/1999 |
| WO | 9611612 | A1 | 4/1996 |
| WO | 2008008235 | A2 | 1/2008 |
| WO | 2011094478 | A1 | 8/2011 |
| WO | 2012162499 | A1 | 11/2012 |
| WO | 2015066030 | A1 | 5/2015 |
| WO | 2015153446 | A1 | 10/2015 |
| WO | 2016092248 | A1 | 6/2016 |

(56) References Cited

FOREIGN PATENT DOCUMENTS

| | | | |
|---|---|---|---|
| WO | 2017155069 | A1 | 9/2017 |
| WO | 2020118009 | A1 | 6/2020 |

OTHER PUBLICATIONS

International Search Report and Written Opinion regarding International Application No. PCT/US2024/013045, dated Jul. 25, 2024.
International Search Report and Written Opinion of the ISA issued in PCT/US2024/024928, mailed Aug. 8, 2024; 1 ISA/US.
International Search Report and Written Opinion regarding International Patent Application No. PCT/US2023/015263, dated Jun. 29, 2023.
International Search Report and Written Opinion of the ISA, issued in PCT/US2023/081628, maiiled Mar. 18, 2024; ISA/US (16 pages).
International Search Report and Written Opinion of the International Searching Authority for Application No. PCT/US2006/031852, dated Jun. 17, 2008.
First Examination Report for New Zealand Application No. 565885, dated Oct. 7, 2009.
International Search Report and Written Opinion of the International Searching Authority for Application No. PCT/US2014/019455, dated May 26, 2014.
International Search Report and Written Opinion of the International Searching Authority for Application No. PCT/US2016/021361, dated May 30, 2016.
International Search Report and Written Opinion of the International Searching Authority for Application No. PCT/US2016/032967, dated Aug. 19, 2016.
International Search Report and Written Opinion of the International Searching Authority for Application No. PCT/US2017/035976, dated Aug. 25, 2017.
International Search Report and Written Opinion of the International Searching Authority for Application No. PCT/US2017/043899, dated Nov. 8, 2017.
First Examination Report for New Zealand Application No. 735460, dated Mar. 2, 2018.
Office Action for Canadian Application No. 2,896,885, dated Mar. 8, 2018.
International Search Report and Written Opinion of the International Searching Authority for Application No. PCT/US2018/025467, dated Jul. 17, 2018.
European Search Report for Application No. 16765435.9, dated Sep. 5, 2018.
European Search Report for Application No. 18159817.8, dated Sep. 26, 2018.
Office Action for Canadian Application No. 2,896,885, dated Oct. 18, 2018.
European Search Report for Application No. 16824840.9, dated Dec. 7, 2018.
First Examination Report for New Zealand Application No. 738919, dated Mar. 14, 2019.
European Search Report for Application No. 19158581.9, dated May 3, 2019.
International Search Report and Written Opinion of the International Searching Authority for Application No. PCT/US2019/021568, dated Jun. 20, 2019.
First Examination Report for Australian Application No. 2016294155, dated Nov. 21, 2019.
First Examination Report for Indian Application No. 201817001204, dated Jan. 3, 2020.
International Search Report and Written Opinion of the International Searching Authority for Application No. PCT/US2019/064607, dated Mar. 26, 2020.
Office Action for Taiwanese Application No. 106116858, dated Apr. 10, 2020. Translation provided by Lee and Li, Attorneys-at-Law.
First Examination Report for Indian Application No. 201717033062, dated Apr. 24, 2020.
International Search Report and Written Opinion of the International Searching Authority for Application No. PCT/US2020/032159, dated Aug. 14, 2020.
Office Action for Taiwanese Application No. 107109634, dated Apr. 19, 2021. Translation provided by Lee and Li, Attorneys-at-Law.
International Search Report and Written Opinion regarding International Application No. PCT/US2021/052135, dated Jan. 3, 2022.
International Search Report and Written Opinion for Application No. PCT/US2021/052135 dated Jan. 3, 2022.
Pivoting Member with Adjustable Friction System—Oct. 30, 2024.
Viva Lift Power Recliners Catalog—Mar. 2019.
Viva Lift Power Recliner Collection Catalog [date unknown].
Viva Lift Power Recliner Collection—Atlas Plus Catalog [date unknown].
Office Action regarding German Patent Application No. 1120210050826, dated Jul. 5, 2025 [machine translation].
Chinese Office Action regarding Application No. 202180065617X dated Jul. 31, 2025 [machine translation].

* cited by examiner

RECLINING CHAISE MECHANISM

CROSS-REFERENCE TO RELATED APPLICATIONS

This application claims the benefit of U.S. Provisional Application No. 63/321,502, filed on Mar. 18, 2022. The entire disclosure of the above application is incorporated herein by reference.

FIELD

The present disclosure relates to motion furniture, and more particularly, to a reclining chaise mechanism.

BACKGROUND

This section provides background information related to the present disclosure and is not necessarily prior art.

In furniture (e.g., chaise lounges, chairs, sofas, loveseats, etc.), functionality is often a tradeoff with aesthetic design. That is, the aesthetic design options of many conventional furniture members often limit motion functionality that can be incorporated into the furniture member. Additionally, furniture members that do offer motion functionality often utilize a complex reclining mechanism with different components for mechanical and powered options. The present disclosure provides furniture members that incorporate aesthetics and functionality that are not found in conventional furniture members.

SUMMARY

This section provides a general summary of the disclosure and is not a comprehensive disclosure of its full scope or all of its features.

The present disclosure provides a furniture member that may include a seat bottom frame, a seatback frame, and a reclining mechanism. The seatback frame may be movable relative to the seat bottom frame between an upright position and a fully reclined position. The reclining mechanism may include a front support member, a rear support member, and a pair of linkages. The seatback frame may be coupled to the seat bottom frame by the pair of linkages. The front support member may be attached to the seat bottom frame and the rear support member is attached to the pair of linkages. The rear support member may be movable relative to the seat bottom frame between a first position and a second position. Movement of the seatback frame between the upright position and the fully reclined position causes corresponding and simultaneous movement of the rear support member and the linkages such that the rear support member is moved into the first position when the seatback frame is moved into the upright position and the rear support member is moved into the second position when the seatback frame is moved into the fully reclined position.

In some configurations of the furniture member of the above paragraph, each of the linkages includes a first link, a second link, and a third link coupled together to move the seatback frame between the upright position and the fully reclined position.

In some configurations of the furniture member of either of the above paragraphs, the rear support member is fixedly attached at one end to the third link of one of the linkages and fixedly attached at another end to the third link of another one of the linkages.

In some configurations of the furniture member of any of the above paragraphs, the rear support member and the third link are movable relative to the seat bottom frame and the seatback frame as the seatback frame moves between the upright position and the fully reclined position.

In some configurations of the furniture member of any of the above paragraphs, the first link is non-rotatably attached to the seatback frame and is rotatably attached to the seat bottom frame, and wherein the second link extends between and is rotatably coupled to the first link and the third link.

In some configurations of the furniture member of any of the above paragraphs, the reclining mechanism includes a gas spring that is rotatably attached to the front support member and the rear support member.

In some configurations of the furniture member of any of the above paragraphs, movement of the gas spring moves the rear support member between a plurality of positions including the first and second positions.

In some configurations of the furniture member of any of the above paragraphs, the gas spring urges the rear support member toward the first position to urge the seatback frame toward the upright position.

In some configurations of the furniture member of any of the above paragraphs, the gas spring is in an extended position when the furniture member is in the upright position and the gas spring is in a retracted position when the furniture member is in the fully reclined position.

In some configurations of the furniture member of any of the above paragraphs, the reclining mechanism includes a linear actuator that is rotatably attached to the front support member and the rear support member, and wherein actuation of the linear actuator powers and controls movement of the rear support member between a plurality of positions including the first and second positions.

In some configurations of the furniture member of any of the above paragraphs, the rear support member includes a first end and a second end and the first and second ends of the rear support member are each attached to the respective ones of the linkages.

The present disclosure provides a furniture member that may include a seat bottom frame, a seatback frame, and a reclining mechanism. The seatback frame may be movable relative to the seat bottom frame between an upright position and a fully reclined position. The reclining mechanism may include a front support member, a rear support member, a pair of linkages, a gas spring, a release mechanism, and a cable, wherein the gas spring extends between the front and rear support members and the cable extends between the release mechanism and the gas spring, wherein the seatback frame is coupled to the seat bottom frame by a pair of linkages. The front support member may be fixedly attached to the seat bottom frame and the rear support member may be attached to the pair of linkages. The rear support member is movable relative to the seat bottom frame and the seatback frame between a first position and a second position, wherein movement of the seatback frame between the upright position and the fully reclined position causes corresponding and simultaneous movement of the rear support member such that the rear support member is moved into the first position when the seatback frame is moved into the upright position and the rear support member is moved into the second position when the seatback frame is moved into the fully reclined position.

In some configurations of the furniture member of the above paragraph, the release mechanism is operable to move between an actuated position and a non-actuated position.

In some configurations of the furniture member of either of the above paragraphs, the release mechanism includes a release lever that is rotatably coupled to a base bracket.

In some configurations of the furniture member of any of the above paragraphs, the gas spring is rotatably attached to the front support member and the rear support member, and wherein movement of the gas spring between an extended position and a retracted position controls movement of the rear support member between a plurality of positions including the first and second positions.

In some configurations of the furniture member of any of the above paragraphs, the gas spring is in the extended position when the furniture member is in the upright position and the gas spring is in the retracted position when the furniture member is in the fully reclined position. The gas spring urges the rear support member toward the first position to urge the seatback frame toward the upright position.

In some configurations of the furniture member of any of the above paragraphs, the gas spring includes a rod and a tube, and wherein the rod slidably moves within the tube in a telescoping manner to move the gas spring between the retracted position and the extended position.

The present disclosure provides a furniture member that may include a seat bottom frame, a seatback frame, and a reclining mechanism. The seatback frame may be movable relative to the seat bottom frame between an upright position and a fully reclined position. The reclining mechanism may include a front support member, a rear support member, a pair of linkages, and a motor-driven linear actuator extending between the front and rear support members. The seatback frame may be coupled to the seat bottom frame by a pair of linkages. The front support member may be fixedly attached to the seat bottom frame and the rear support member may be attached to the pair of linkages. The rear support member may be movable relative to the seat bottom frame between a first position and a second position, wherein movement of the seatback frame between the upright position and the reclined position causes corresponding and simultaneous movement of the rear support member such that the rear support member is moved into the first position when the seatback frame is moved into the upright position and the rear support member is moved into the second position when the seatback frame is moved into the reclined position.

In some configurations of the furniture member of the above paragraph, the linear actuator is rotatably attached to the front support member and the rear support member, wherein actuation of the linear actuator powers and controls movement of the rear support member between a plurality of positions including the first and second positions.

In some configurations of the furniture member of any of the above paragraphs, the linear actuator includes a first arm, a second arm, and a motor, wherein the second arm is slidably disposed within the first arm, and wherein the motor drives the second arm relative to the first arm.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
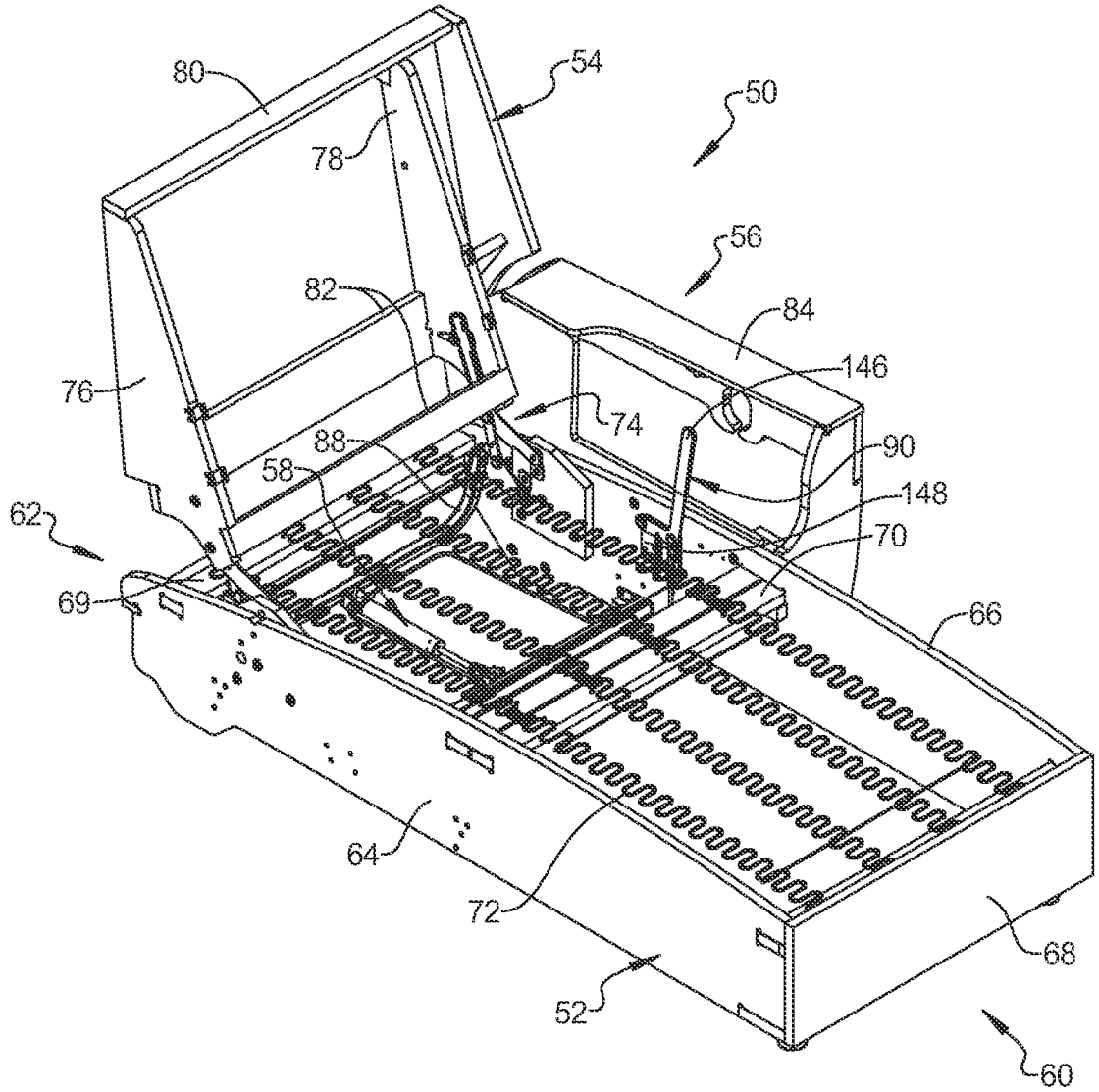
FIG. 1 is a perspective view of a furniture member with a reclining mechanism and a seatback frame in an upright position according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
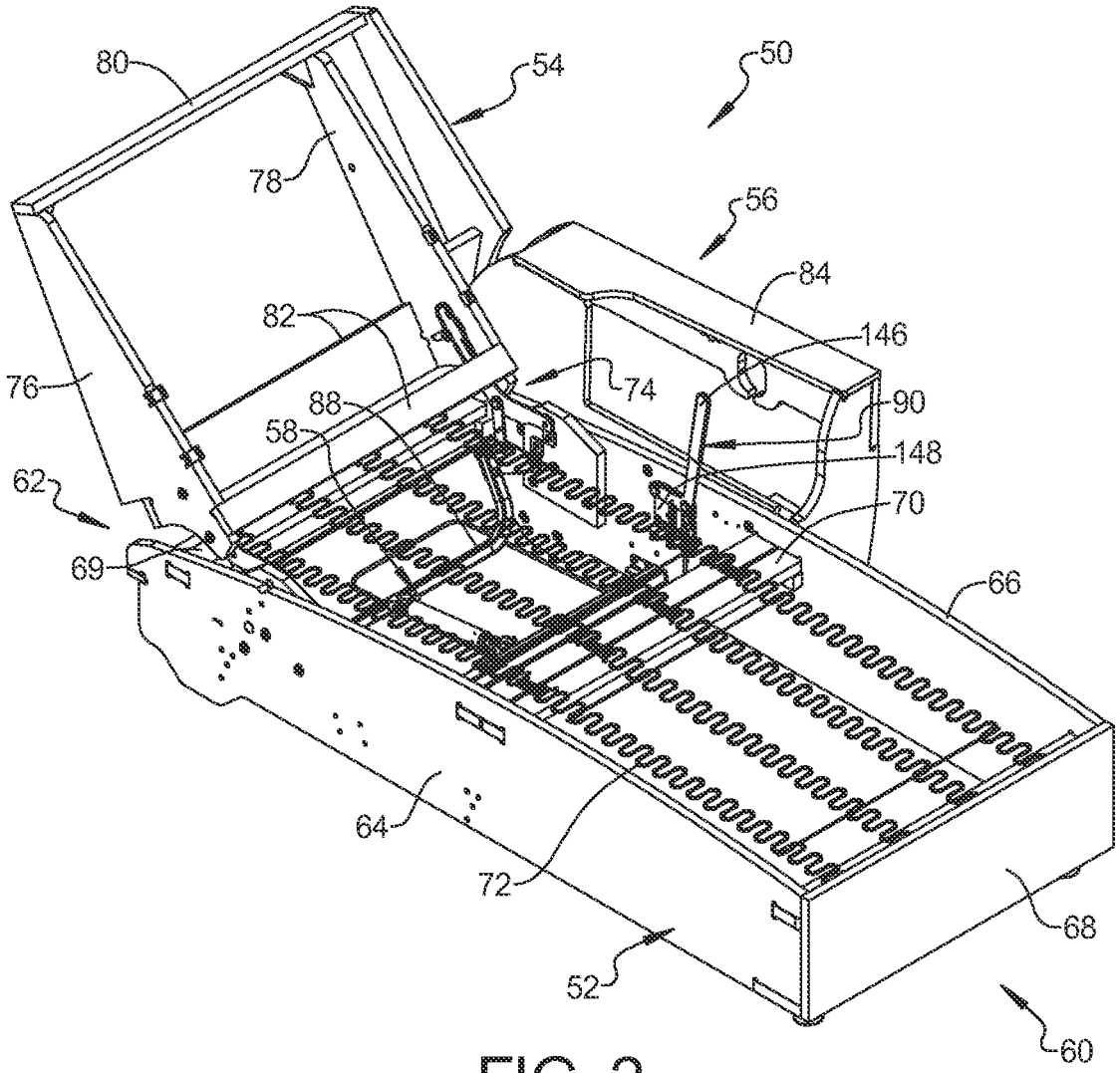
FIG. 2 is a perspective view of the furniture member with the reclining mechanism and the seatback frame in a fully reclined position according to the principles of the present disclosure.

With reference to FIGS. 1-2, a furniture member 50 is provided that may include a seat bottom frame 52, a seatback frame 54, an armrest frame 56, and a reclining mechanism 58. The furniture member 50 has a first furniture end 60 and a second furniture end 62. The furniture member 50 may be a chaise. In some configurations, the furniture member 50 could be a standalone furniture item. In other configurations, the furniture member 50 may be a section of a sectional sofa, for example.

As will be described in more detail below, the seatback frame 54 is movable relative to the seat bottom frame 52 between an upright position (FIG. 1) and a fully reclined position (FIG. 2). The seatback frame 54 can also be moved to a plurality of partially reclined or intermediate positions between the upright position and fully reclined position. While not shown in the figures, the furniture member 50 may include one or more springs that bias the seatback frame 54 toward the upright position.

The seat bottom frame 52 may be a stationary frame. The seat bottom frame 52 may include a first side panel or support member 64, a second side panel or support member 66, a front panel or support member 68, a rear panel or support member 69, at least one cross member or intermediate support panel 70, and a plurality of springs 72. Each of the first and second side panels 64, 66 may be orthogonally connected to the front panel 68 at opposite ends of the front panel 68. The cross member 70 extends laterally and may be fixedly attached to the first and second side panels 64, 66 at opposite ends. The springs 72 may be disposed longitudinally and fixedly attached to the front panel 68 and the cross member 70.

The seatback frame 54 may be coupled to the seat bottom frame 52 by a pair of linkages 74 that allow the seatback frame 54 to move relative to the seat bottom frame 52 between the upright position (FIG. 1) and the fully reclined position (FIG. 2). The seatback frame 54 may include a first seatback panel 76, a second seatback panel 78, a top seatback panel 80, and a seatback support panel 82. The first and second seatback panels 76, 78 extend longitudinally. The top seatback panel 80 and the seatback support panel 82 extends laterally. The top seatback panel 80 may be fixedly attached to the first seatback panel 76 and the second seatback panel 78 at opposite ends. The seatback support panel 82 may be fixedly attached to the first seatback panel 76 and the second seatback panel 78 at opposite ends.

The armrest frame 56 may be fixedly attached to the first or second side panel 64, 66. A right armrest (not shown) is defined when the armrest frame is attached to the first side panel 64. As shown in FIGS. 1 and 2, a left armrest 84 is defined when the armrest frame 56 is attached to the second side panel 66.

While not shown in the figures, the seat bottom frame 52, seatback frame 54, and armrest frame 56 may support cushions and may be covered with upholstery. In some configurations, support springs may be attached to the seatback frame 54 and the support springs may support cushions.

With reference to FIGS. 3 to 18, the reclining mechanism 58 may include a front support member 86, a rear support member 88, the pair of linkages 74, a release mechanism 90, a cable 92, and a gas spring 94.

Figure 3:
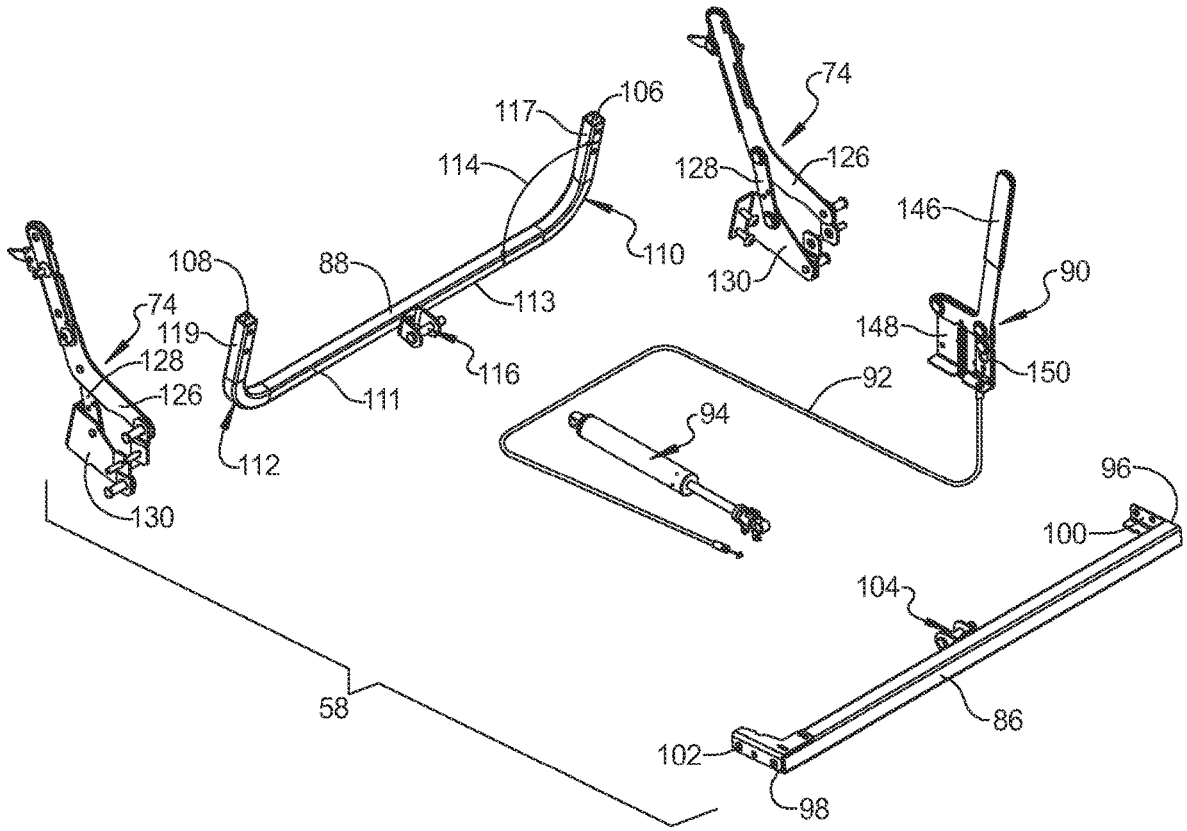
FIG. 3 is a partially exploded view of the reclining mechanism of FIG. 1.
Figure 4:
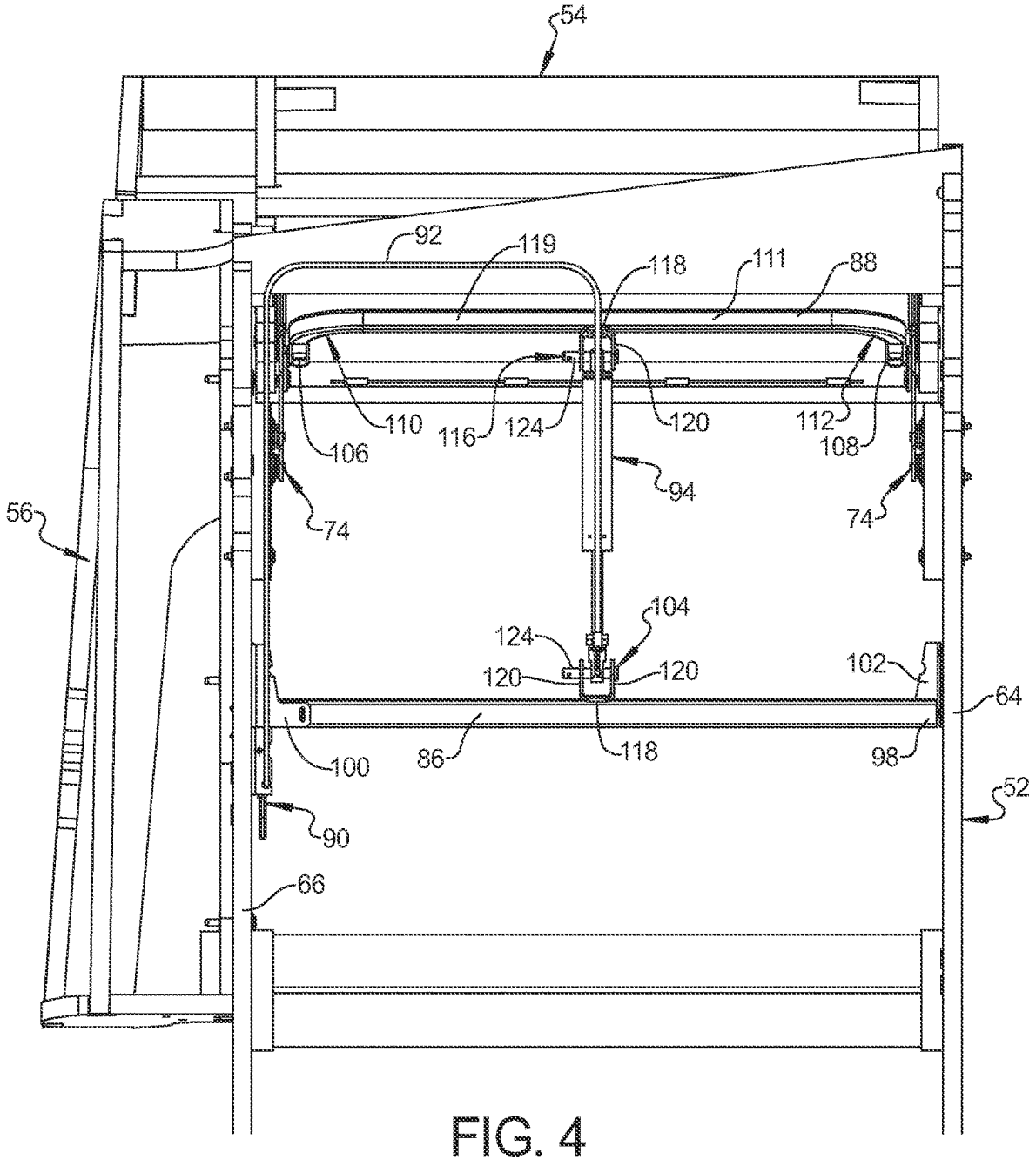
FIG. 4 is a partial bottom view of the furniture member of FIG. 1 with the seatback frame in the upright position.
Figure 5:
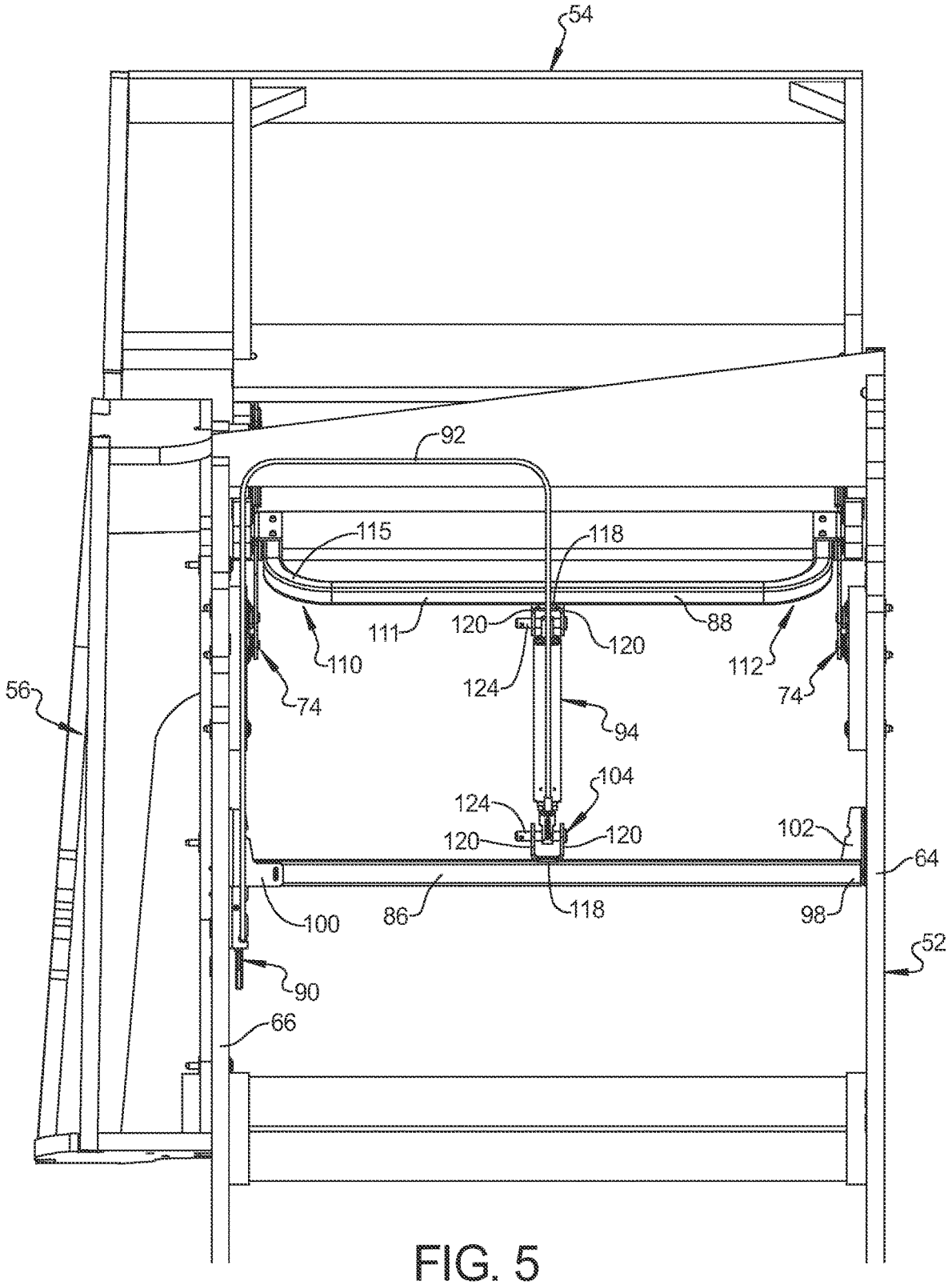
FIG. 5 is a partial bottom view of the furniture member of FIG. 2 with the seatback frame in the fully reclined position.

As shown in FIGS. 3 to 5, the front support member 86 includes a first end 96 and a second end 98. A first bracket 100 may be disposed at the first end 96. A second bracket 102 may be disposed at the second end 98. The first and second brackets 100, 102 may fixedly attach the front support member 86 to the seat bottom frame 52. The front support member 86 may include a first clevis 104 positioned between the first and second ends 96, 98. In the configuration shown in the figures, the first clevis 104 is positioned approximately equidistantly between the first and second ends 96, 98. The first clevis 104 may extend from the front support member 86 toward the second furniture end 62.

The rear support member 88 includes a first end 106 and a second end 108. The rear support member 88 may be generally U-shaped. For example, the rear support member 88 may have a first bend 110 near the first end 106 and a second bend 112 near the second end 108. The rear support member 88 may include a front wall 113, a rear wall 115 (FIG. 5), an inner wall 117, and an outer wall 119 that cooperate to form a tube-like configuration. An intermediate portion 111 of the rear support member 88 may extend between the first and second bends 110, 112. The first and second bends 110, 112 may have an angle 114 of approximately 90 degrees to form the U-shape of the rear support member 88. The first and second ends 106, 108 of the rear support member 88 may be attached to respective linkages 74. The rear support member 88 may include a second clevis 116 disposed between the first and second bends 110, 112. In the configuration shown in the figures, the second clevis 116 may be positioned approximately equidistantly between the first and second bends 110, 112. The second clevis 116 may extend from the rear support member 88 toward the first furniture end 60 and may be aligned with the first clevis 104.

As shown in FIGS. 4 and 5, each of the first and second clevises 104, 116 may include a back wall 118 and pair of protruding walls 120. The back wall 118 of the first clevis 104 may be attached to the front support member 86 and the back wall 118 of the second clevis 116 may be attached to the rear support member 88. The pair of protruding walls 120 may extend from the back wall 118 at opposite ends of the back wall 118. A clevis pin 124 (or fastener) may extend through each protruding wall 120. The clevis pins 124 may couple the first and second clevises 104, 116 with the gas spring 94.

Movement of the seatback frame 54 between the upright position and the fully reclined position causes corresponding and simultaneous movement of the rear support member 88 relative to the seat bottom frame 52 and the seatback frame 54. More specifically, the rear support member 88 may move with the pair of linkages 74 between a first position (FIG. 4) and a second position (FIG. 5). The rear support member 88 is in the first position when the seatback frame 54 is in the upright position. The rear support member 88 is in the second position when the seatback frame 54 is in the fully reclined position. In the first position, the rear support member 88 is angled generally toward the second furniture end 62. In the second position, the rear support member 88 is angled generally toward the first furniture end 60. Thus, in the second position, the intermediate portion 111 of the rear support member 88 is horizontally forward relative to the first position (i.e., the intermediate portion 111 is closer to the first furniture end 60 in the second position than in the first position).

The pair of linkages 74 may be attached to the seat bottom frame 52, seatback frame 54, and rear support member 88. The pair of linkages 74 allow the seatback frame 54 to move relative to the seat bottom frame 52 between the upright position (FIGS. 1 and 4) and the fully reclined position (FIGS. 2 and 5). The pair of linkages 74 allow the rear support member 88 to move between the first position (FIG. 4) and the second position (FIG. 5). One of the linkages 74 may be coupled to the second side panel 66, second seatback panel 78, and the first end 106 of the rear support member 88. The other linkage may be coupled to the first side panel 64, the first seatback panel 76, and the second end 108 of the rear support member 88.

Figure 6:
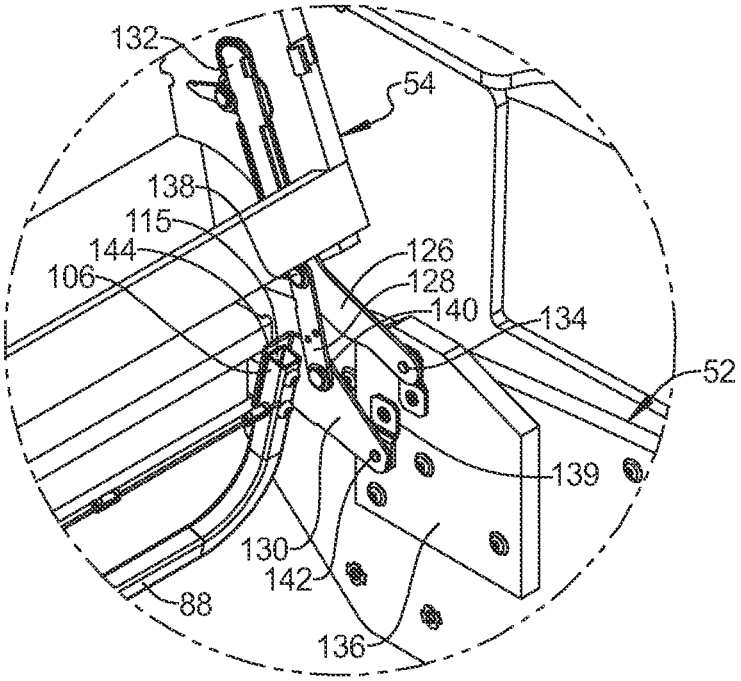
FIG. 6 is an enlarged perspective view of a linkage of the reclining mechanism of the furniture member of FIG. 1 with the seatback frame in the upright position.
Figure 7:
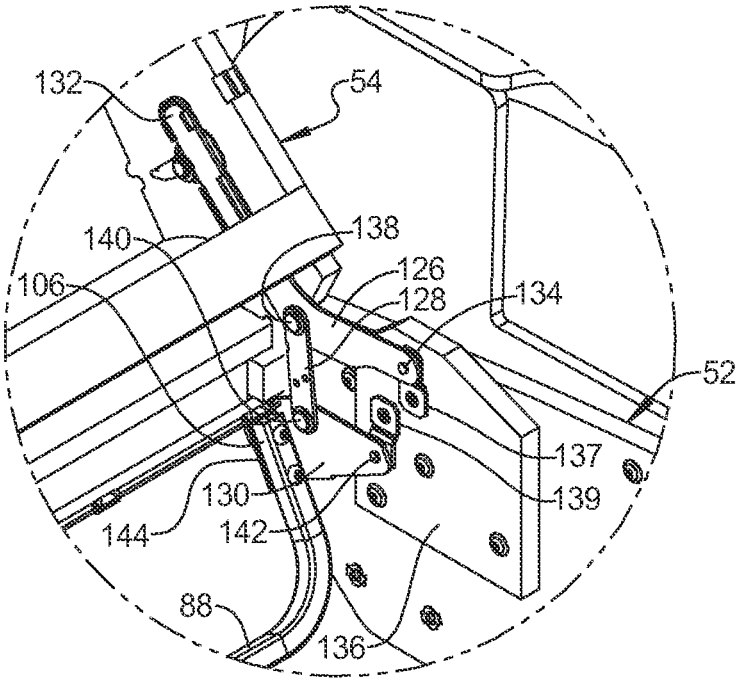
FIG. 7 is an enlarged perspective view of the linkage of the reclining mechanism of the furniture member of FIG. 2 with the seatback frame in the fully reclined position.

Referring now to FIGS. 6 and 7, each of the linkages 74 may include a first link 126, a second link 128, and a third link 130. The first link 126 includes a first link end 132 and a second link end 134. The first link end 132 may be fixedly attached to the seatback frame 54. The second link end 134 may be rotatably coupled to the seat bottom frame 52 (e.g., via a support block 136 and bracket 137). The second link 128 includes between a first link end 138 and a second link end 140. The first link end 138 may be rotatably coupled to the first link 126. The second link end 140 may be rotatably coupled to the third link 130. The third link 130 includes a first link end 142 and a second link end 144. The first link end 142 may be rotatably coupled to the seat bottom frame 52 (e.g., via the support block 136 and bracket 139). The second link end 144 may be fixedly attached to the rear wall 115 of the rear support member 88. That is, the first end 106 of the rear support member 88 may be fixedly attached to the second link end 144 of the third link 130 of one of the linkages 74, and the second end 108 of the rear support member 88 may be fixedly attached to the second link end 144 of the third link 130 of the other one of the linkages 74.

During movement of the seatback frame 54 between the upright position (FIG. 6) and the fully reclined position (FIG. 7), the first link 126, the second link 128 and the third link 130 simultaneously move. For example, a force applied to the seatback frame 54 may drive the first link 126 to pivot at the second link end 134 and simultaneously move the second link 128 and third link 130, thereby moving the rear support member 88 between the first and second positions.

Figure 8:
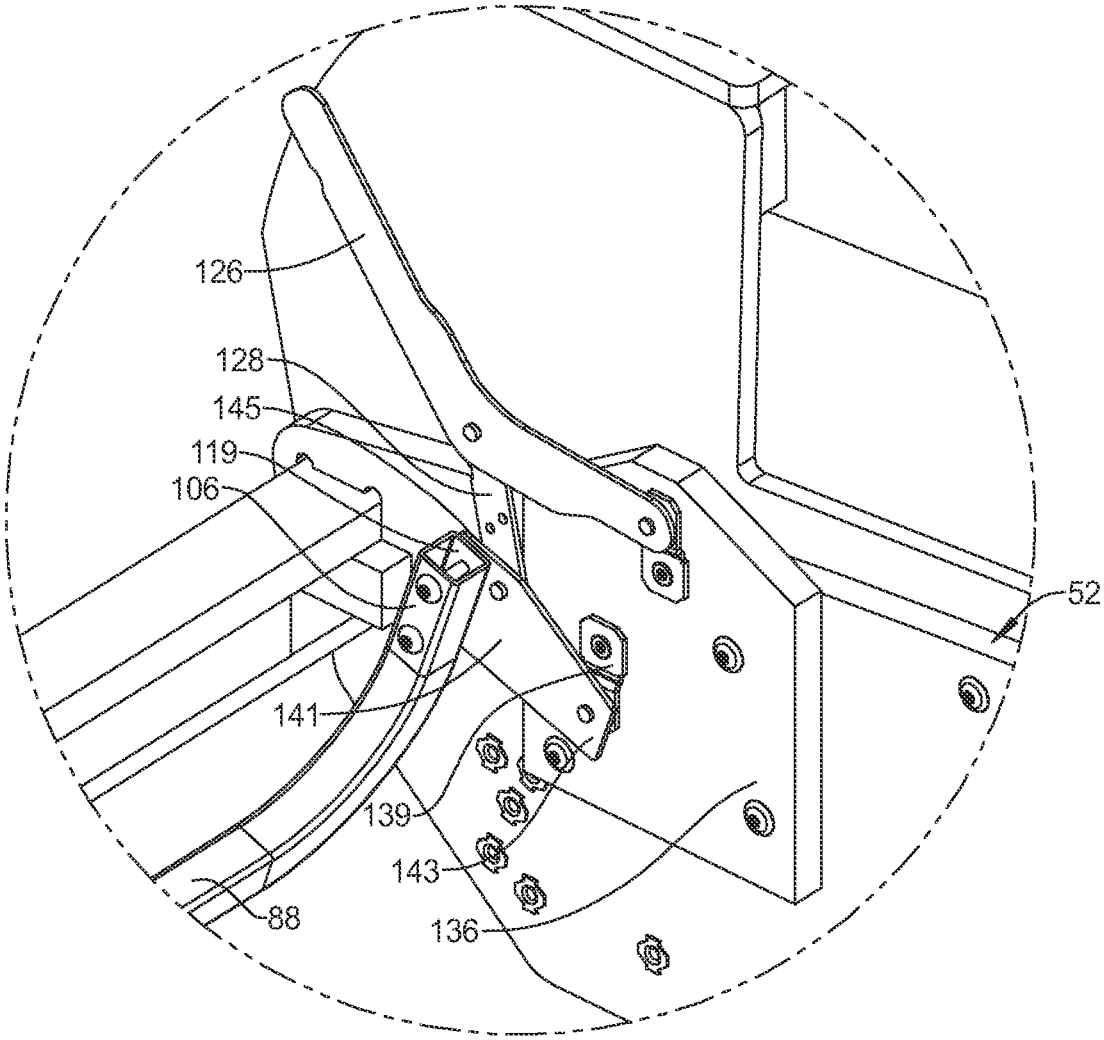
FIG. 8 is an enlarged perspective view of an alternative linkage of the reclining mechanism of the furniture member of FIG. 1 with the seatback frame in the upright position.

FIG. 8 depicts another example of a third link 141 that can be incorporated into the furniture member 50 instead of the third link 130. The third link 141 includes a first link end 143 and a second link end 145. The first link end 143 may be rotatably coupled to the seat bottom frame 52 (e.g., via the support block 136 and bracket 139). The second link end 145 is fixedly attached to the rear support member 88. More specifically, the second link end 145 is fixedly attached to the outer wall 119 of the rear support member 88. That is, the first end 106 of the rear support member 88 may be fixedly attached to the second link end 145 of the third link 141 of one of the linkages 74, and the second end 108 of the rear support member 88 may be fixedly attached to the second link end 145 of the third link 131 of the other one of the linkages 74.

Figure 9:
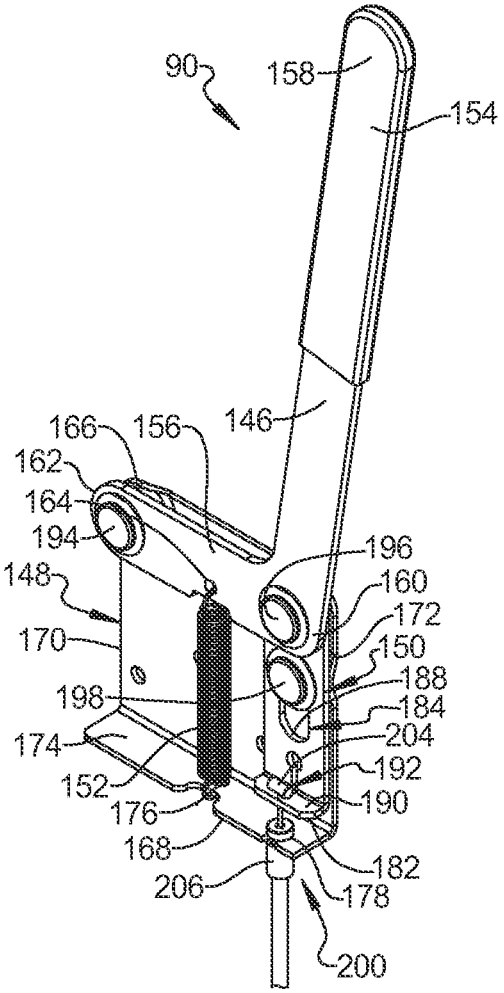
FIG. 9 is a perspective view of a release mechanism and a cable of the reclining mechanism with the release mechanism and cable in a non-actuated position.
Figure 10:
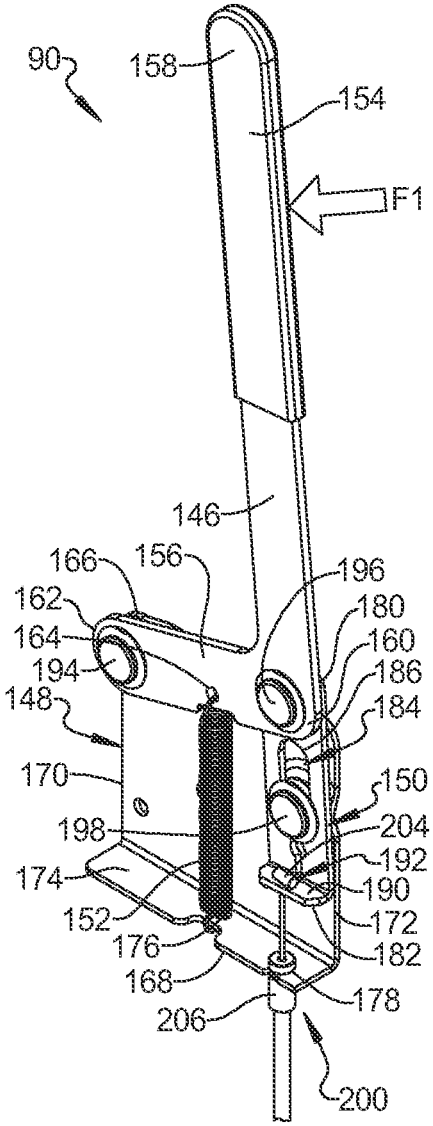
FIG. 10 is a perspective view of the release mechanism and the cable of the reclining mechanism with the release mechanism and cable in an actuated position.

As shown in FIGS. 9 and 10, the release mechanism 90 may include a release lever 146, a base bracket 148, a link 150, and a spring 152. The release mechanism 90 may be attached to the same seat bottom panel as the armrest frame 56.

The release lever 146 may include a graspable portion 154 and a lever connection portion 156. A sleeve 158 (e.g., formed from a polymeric material) may cover or partially cover the graspable portion 154 in order to provide a user with enhanced comfort and a more robust grasp on the release lever 146. The lever connection portion 156 includes a first lever end 160 and a second lever end 162. A first spring aperture 164 may be disposed through the lever connection portion 156 and positioned between the first and second lever ends 160, 162.

The base bracket 148 may be fixedly attached to the seat bottom frame 52. The base bracket 148 extends longitudinally between a first base bracket end 166 and a second base bracket end 168, and laterally between a third base bracket end 170 and a fourth base bracket end 172. A base bracket protrusion or ledge 174 may be disposed at the second base bracket end 168 and may extend laterally between the third and fourth base bracket ends 170, 172. The base bracket protrusion 174 may include a second spring aperture 176 and a first cable slot or aperture 178. The second spring aperture 176 is aligned with the first spring aperture 164 such that the spring 152 extends between and engages the first spring aperture 164 and the second spring aperture 176. The first cable aperture 178 may be positioned adjacent to the fourth base bracket end 172.

The link 150 includes a first intermediate bracket end 180 and a second intermediate bracket end 182. The link 150 includes an oblong opening or slot 184 and an intermediate bracket protrusion or ledge 190. The oblong opening 184 may extend vertically between a first opening end 186 and a second opening end 188. The intermediate bracket protrusion 190 may be positioned at the second intermediate bracket end 182 and includes a cable opening 192.

The release mechanism 90 may include a first connector 194, a second connector 196, and a third connector 198. The first, second, and third connectors 194, 196, 198 may be pivot pins or fasteners, for example. The release lever 146 may be pivotally coupled to the base bracket 148 at the first connector 194. The first connector 194 extends through the release lever 146 at the second lever end 162 of the lever connection portion 156 and through the base bracket 148 at the intersection between the first and third base bracket ends 166, 170. The release lever 146 may be attached to the link 150 via the second connector 196. The second connector 196 is disposed through the release lever 146 at the first lever end 160 of the lever connection portion 156 and through the link 150 at the first intermediate bracket end 180. The link 150 may be slidably coupled to the base bracket 148 via the third connector 198. The third connector 198 is slidably received in the oblong opening 184 of the link 150 and extends through the base bracket 148 adjacent to the fourth base bracket end 172.

The cable 92 includes a control end 200 and a gas spring end 202. The control end 200 is coupled to the link 150 of the release mechanism 90. The gas spring end 202 is coupled to the gas spring 94. More specifically, the cable 92 may include a first cable head 204 and a first cable collar 206 at the control end 200. The cable 92 may include a second cable head 208 and a second cable collar 210 at the gas spring end 202. The first cable head 204 of the control end 200 is positioned through the cable opening 192 of the link 150 and rests on the intermediate bracket protrusion 190 of the link 150. The first cable collar 206 may be received within the first cable aperture 178 of the base bracket 148.

The release lever 146 is movable between a non-actuated position (FIG. 9) and an actuated position (FIG. 10). The user may apply a force F1 to the release lever 146 at the graspable portion 154. When the force F1 is applied, the release lever 146 rotates (relative to the base bracket 148) about the first connector 194 which simultaneously moves the link 150 vertically upward relative to the base bracket 148. As the link 150 moves vertically upward, the oblong opening 184 of the link 150 moves along the third connector 198 to slide the second opening end 188 of the oblong opening 184 toward the third connector 198. The movement of the link 150 upward applies a pulling force on the cable 92 (i.e., the first cable head 204 is moved vertically upward). The user may release the release lever 146 (i.e., stop applying force F1) to allow the spring 152 to urge the release lever 146 back to the non-actuated position and thereby release the cable 92.

The release mechanism 90 can have a variety of different configurations that allow the user to move the release mechanism 90 between an actuated position and a non-actuated position, resulting in the pull and release of the cable 92. For example, the release mechanism 90 may lock into the actuated position and user may apply a force at the graspable portion 154 of the release lever 146 to move the release mechanism 90 from the actuated position to the non-actuated position.

Figure 11:
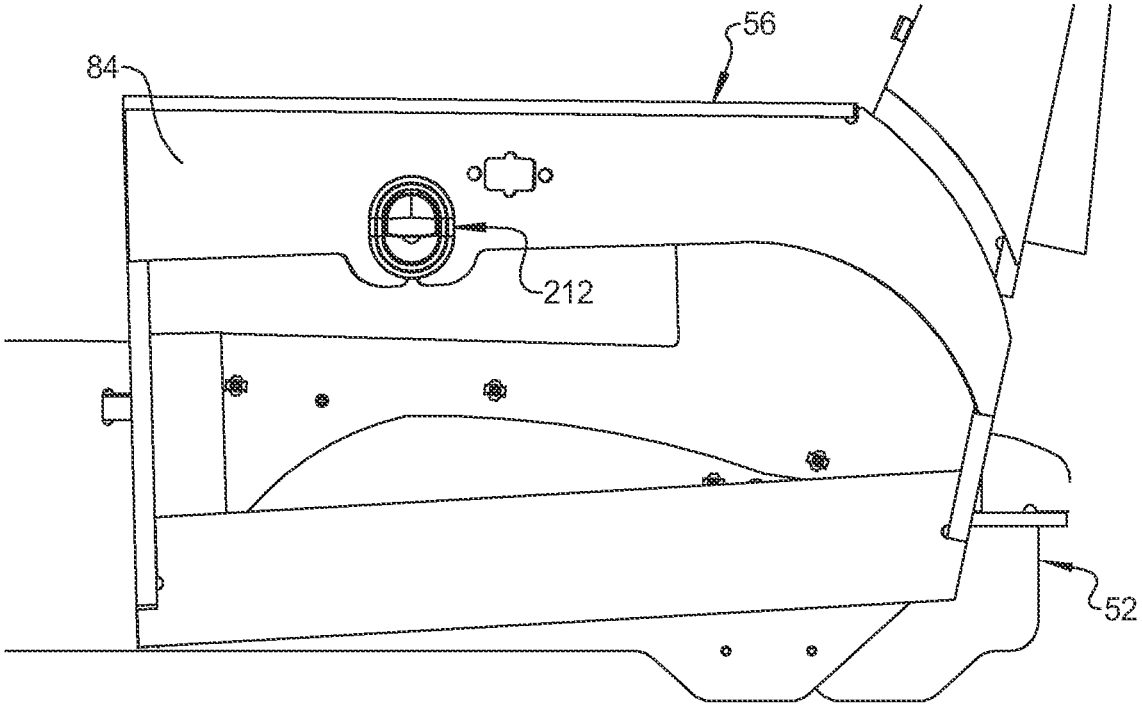
FIG. 11 is a partial side view of the furniture member with an alternative release mechanism.
Figure 12:
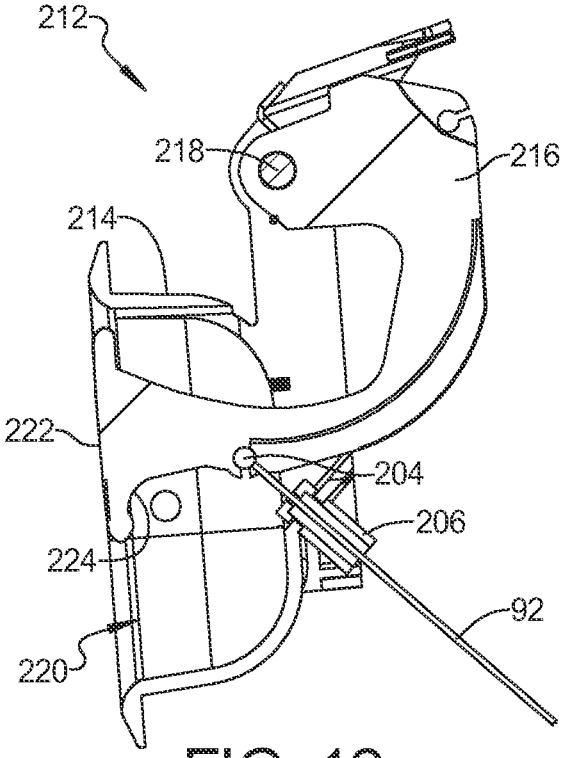
FIG. 12 is a cross-sectional view of the release mechanism of FIG. 11 in a non-actuated position.
Figure 13:
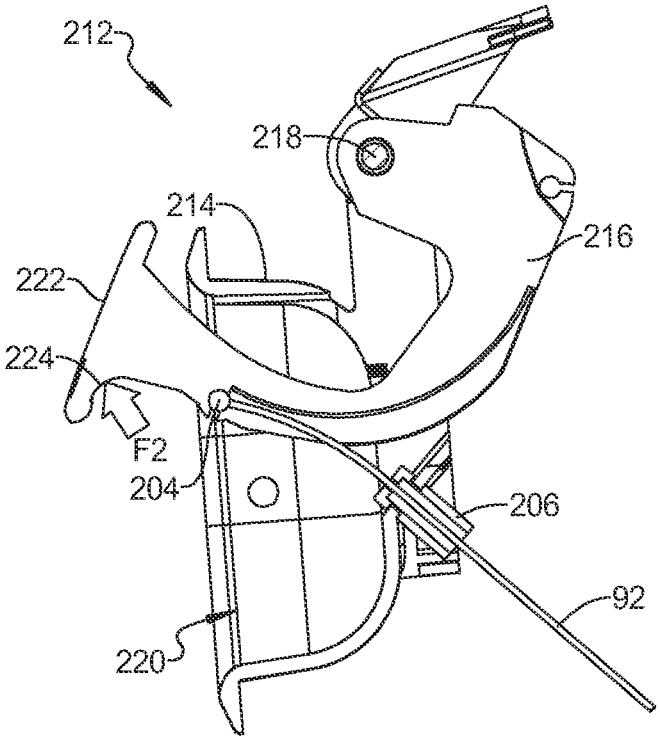
FIG. 13 is a cross-sectional view of the release mechanism of FIG. 11 in an actuated position.

FIGS. 11-13 depict another example of a release mechanism 212 that can be incorporated into the furniture member 50 instead of the release mechanism 90. As shown in FIG. 11, the release mechanism 212 may be mounted to the armrest frame 56 or to the seat bottom frame 52, for example. The release mechanism 212 may include a housing or base bracket 214 and a release lever 216. The housing 214 includes a pivot 218 and an opening 220. The release lever 216 is rotatably coupled to the housing 214 at the pivot 218. The release lever 216 extends through the opening 220 of the housing 214. The control end 200 of the cable 92 is attached to the release lever 216 such that movement of the release lever 216 causes corresponding movement of the cable 92.

An end 222 of the release lever 216 may include a lip or flange 224. In some configurations, the end 222 of the release lever 216 can include a ring, knob, and/or any other feature that allows the user to easily grip and pull on the release lever 216. The user may rotate the release lever 216 upward and outward from the housing 214 by applying a force F2 to the lip 224 with one or more of the user's fingers, for example. When the user applies the force F2, the release lever 216 rotates at the pivot 218 from a non-actuated position (FIG. 12) to an actuated position (FIG. 13). When the user releases the lip 224, a spring may urge the release lever 216 back toward the non-actuated position.

Although the examples shown in FIGS. 9-13 include a handle-type and a pull-type release lever, another suitable type of release lever may be attached to the cable 92 and may move between an actuated position and a non-actuated position.

With reference to FIGS. 14-18, the gas spring 94 moves between an extended position (FIGS. 14-16) and retracted position (FIGS. 17 and 18) with the movement of the seatback frame 54 between the upright and fully reclined positions. When the seatback frame 54 is in the upright position, the gas spring 94 is in the extended position. When the seatback frame 54 is in the fully reclined position, the gas spring 94 is in the retracted position.

Figure 16:
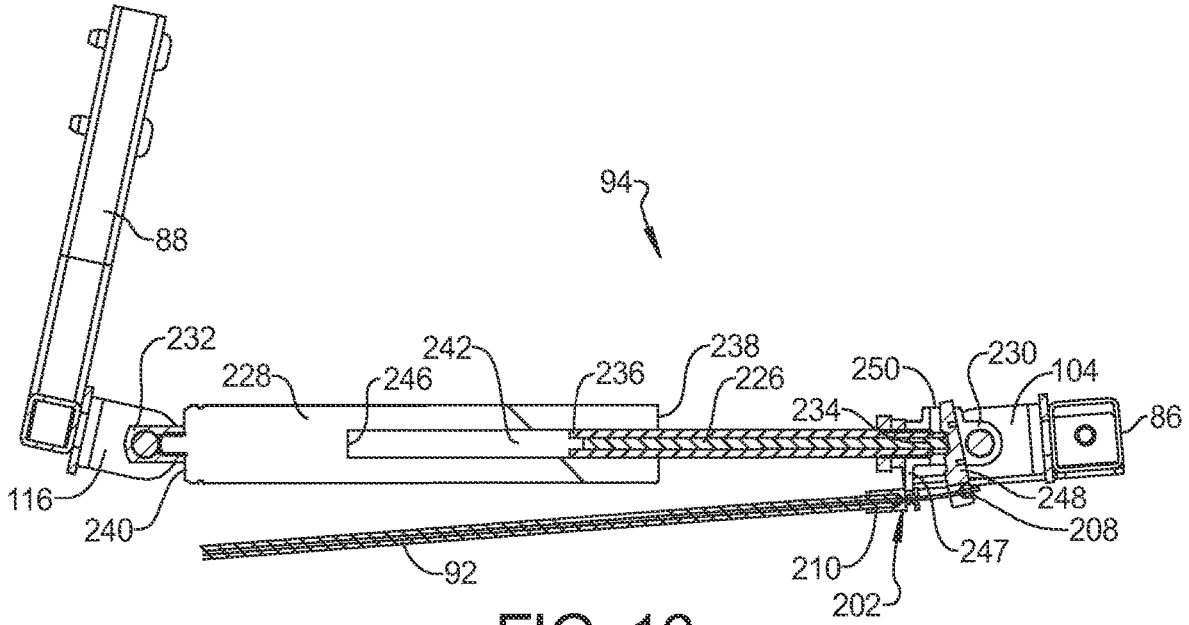
FIG. 16 is a cross-sectional view of the reclining mechanism of FIG. 15 with the rear support member in the first position, the gas spring in the extended position, and the cable in the non-actuated position.
Figure 17:
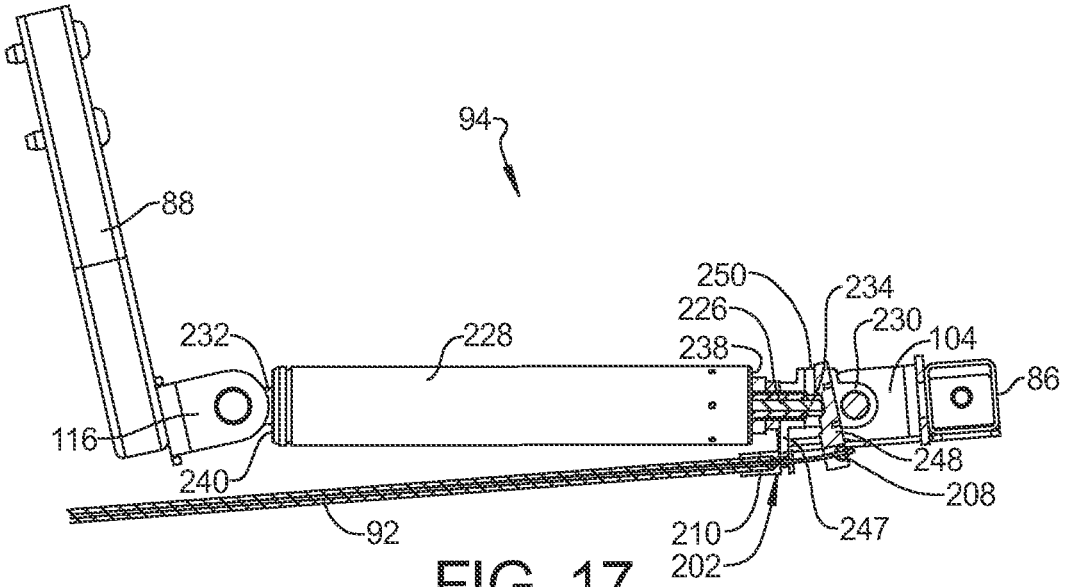
FIG. 17 is a partial cross-sectional view of the reclining mechanism of FIG. 2 with the rear support member in a second position, the gas spring in a retracted position, and the cable in the non-actuated position.
Figure 18:
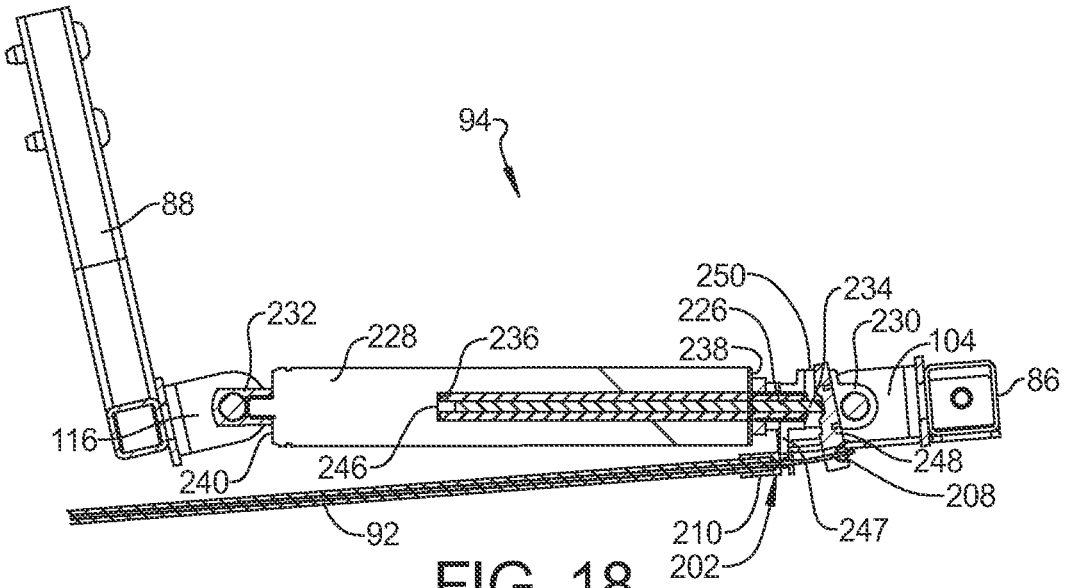
FIG. 18 is a cross-sectional view of the gas spring of FIG. 17 with the rear support member in the second position, the gas spring in the retracted position, and the cable in the non-actuated position.
Figure 19:
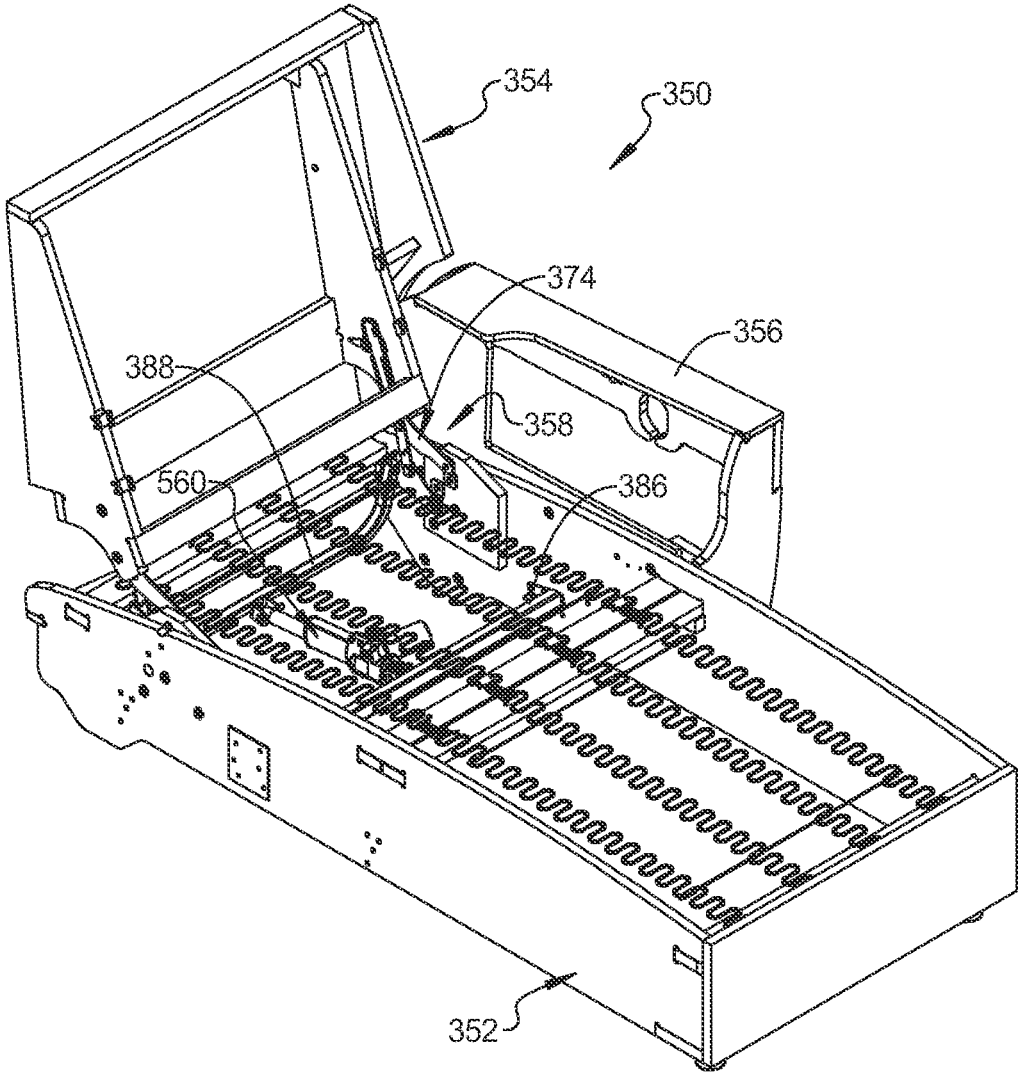
FIG. 19 is a perspective view of another furniture member with another reclining mechanism and a seatback frame in an upright position according to the principles of the present disclosure.

The gas spring 94 may include a rod 226, a tube or cylinder 228, a first clevis connection 230, and a second clevis connection 232. The rod 226 includes a first rod end 234 and a second rod end 236 (FIGS. 16 and 18). The tube 228 includes a first tube end 238 and a second tube end 240. The tube 228 includes an opening or aperture 242 that may include an open end at the first tube end 238 and a closed end 246 (FIGS. 16 and 18) disposed between the first and second tube ends 238, 240.

The rod 226 may be received in the aperture 242 of the tube 228. The first rod end 234 is positioned outside of the tube 228 and the second rod end 236 is positioned within the aperture 242. The rod 226 may be movable relative to the aperture 242 in a telescoping (or reciprocating) manner.

The first clevis connection 230 is disposed at the first rod end 234. The first clevis connection 230 may be fixedly attached to or integrally formed with the rod 226. The first clevis connection 230 rotatably engages the clevis pin 124 of the first clevis 104 of the front support member 86. The second clevis connection 232 is disposed at the second tube end 240. The second clevis connection 232 may be fixedly attached to or integrally formed with the tube 228. The second clevis connection 232 rotatably engages the clevis pin 124 of the second clevis 116 of the rear support member 88.

The first clevis connection 230 may include a main body 247 and a release arm 248 that is rotatably coupled to the main body 247. The main body 247 is fixed to or integrally formed with the rod 226 and includes an aperture 250. The release arm 248 extends at least partially through the aperture 250 and is rotatable therein relative to the main body 247. The gas spring end 202 of the cable 92 may be attached to the release arm 248.

Figure 14:
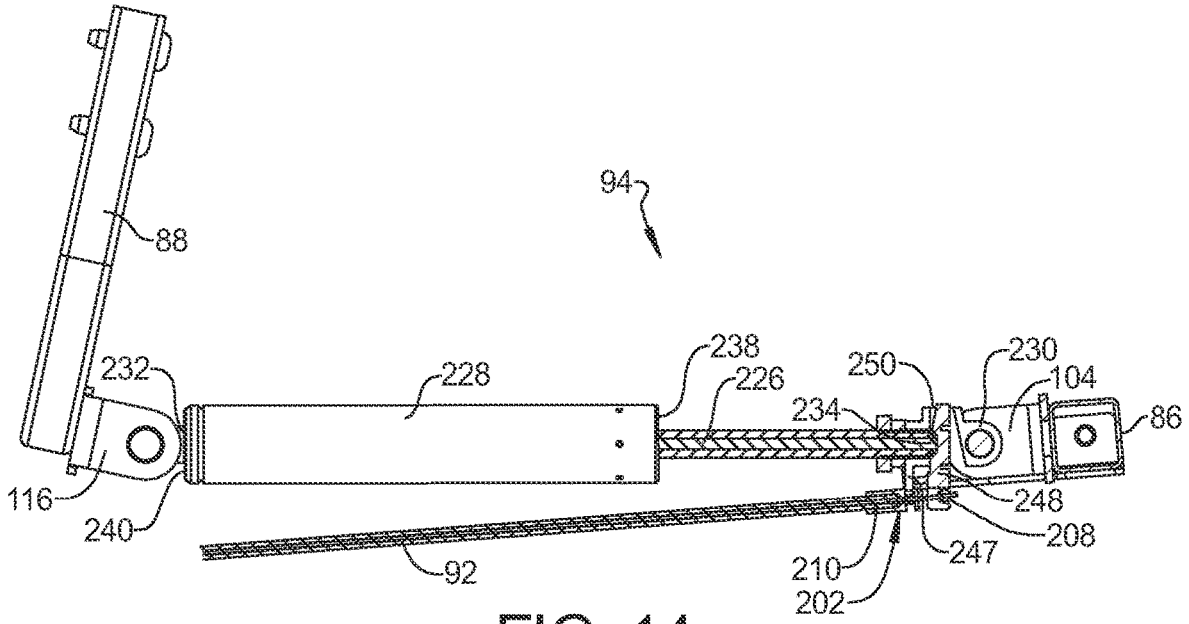
FIG. 14 is a partial cross-sectional view of the reclining mechanism of FIG. 1 with a rear support member in a first position, a gas spring in an extended position, and the cable in the actuated position.
Figure 15:
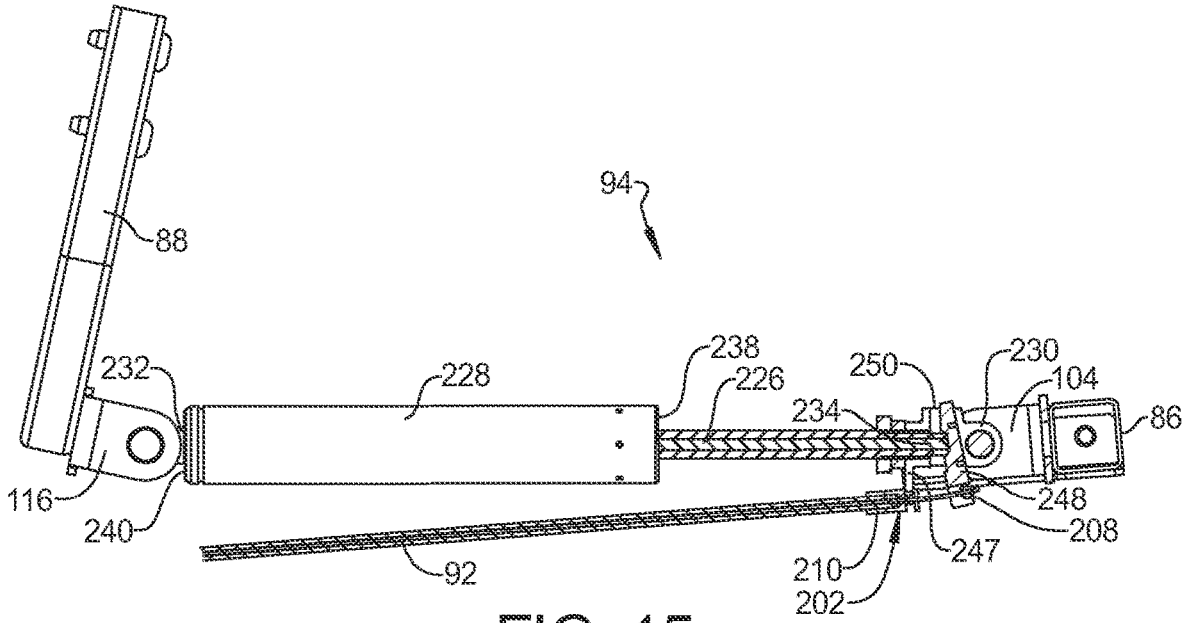
FIG. 15 is a partial cross-sectional view of the reclining mechanism of FIG. 1 with the rear support member in the first position, the gas spring in the extended position, and the cable in the non-actuated position.

The release arm 248 rotates within the aperture 250 relative to the main body 247 between an actuated position (FIG. 14) and a non-actuated position (FIGS. 15-18). The position of the release arm 248 corresponds to the position of the release mechanism 90. More specifically, when the release mechanism 90 is in the non-actuated position, the release arm 248 is in the non-actuated position, and when the release mechanism 90 is in the actuated position, the release arm 248 is in the actuated position. When the release mechanism 90 is actuated by the user, the cable 92 pulls the release arm 248 from the non-actuated position (FIG. 15-18) toward actuated position (FIG. 14).

Movement of the release arm 248 from the non-actuated position to the actuated position unlocks the rod 226 to slide within the aperture 242 of the tube 228 in a telescoping manner. As shown in FIGS. 16, the rod 226 may move away from the closed end 246 of the aperture 242 to place the gas spring 94 in the extended position. As shown in FIGS. 18, the rod 226 may slide towards the closed end 246 to place the gas spring 94 in the retracted position. Movement of the rod 226 toward the closed end 246 may build up gas pressure in the aperture 242. The built-up gas pressure in the aperture 242 can be used to move the rear support member 88 from the second position (corresponding to the fully reclined position of the seatback frame 54) toward the first position (corresponding to the upright position of the seatback frame 54). In this manner, the gas spring 94 biases the seatback frame 54 toward the upright position when the release mechanism 90 is in the actuated position. When the release mechanism 90 is in the non-actuated position, the gas spring 94 restricts or prevents movement of the seatback frame 54 between the upright and fully reclined positions.

In some configurations, the furniture member 50 may include an auto-return feature for moving the seatback frame 54 from the fully reclined position or one of the intermediate positions to the upright position. When the furniture member 50 is in the fully recline position or one of the intermediate positions, an occupant of the furniture member 50 may apply a force against the seatback frame 54 while the occupant rests against the seatback frame 54.

In one example of the auto-return feature, the furniture member 50 may be able to sense when the occupant of the furniture member 50 lifts from the seatback frame 54 (e.g., when the occupant no longer applies the force against the seatback frame 54) and automatically returns the seatback frame 54 to the upright position. More specifically, the built-up gas pressure in the aperture 242 of the gas spring 94 is used to move the rear support member 88 toward the first position (corresponding to the upright position of the seatback frame 54) and thereby, returns the seatback frame 54 to the upright position.

In another example of the auto-return feature, the furniture member 50 may include a control. When the user actuates the control (e.g., presses the control), the seatback frame 54 may move automatically from the fully reclined position or one of the intermediate positions to the upright position.

With reference to FIGS. 19-27, another furniture member 350 is provided. The structure and function of the furniture member 350 may be similar or identical to that of the furniture member 50 described above, apart from certain exceptions described below.

Figure 20:
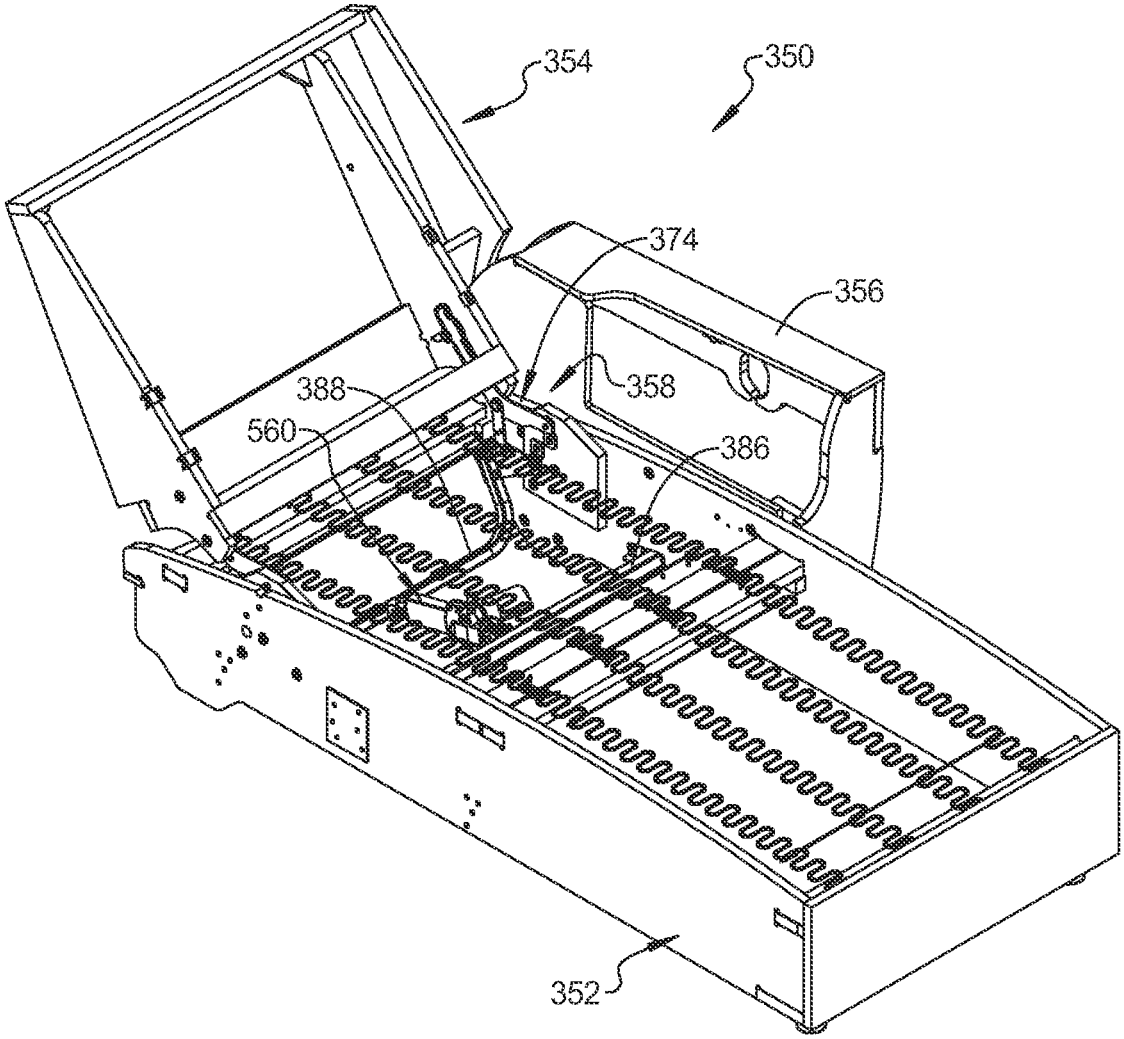
FIG. 20 is a perspective view of the furniture member of FIG. 19 with the seatback frame in a fully reclined upright position.

Like the furniture member 50, the furniture member 350 may include a seat bottom frame 352, a seatback frame 354, an armrest frame 356, and a reclining mechanism 358. The seatback frame 354 is movable relative to the seat bottom frame 352 between an upright position (FIG. 19) and a fully reclined position (FIG. 20). The structure and function of the seat bottom frame 352, seatback frame 354, and armrest frame 356 may be similar or identical to that of the seat bottom frame 52, the seatback frame 54, and armrest frame 56 described above.

Figure 21:
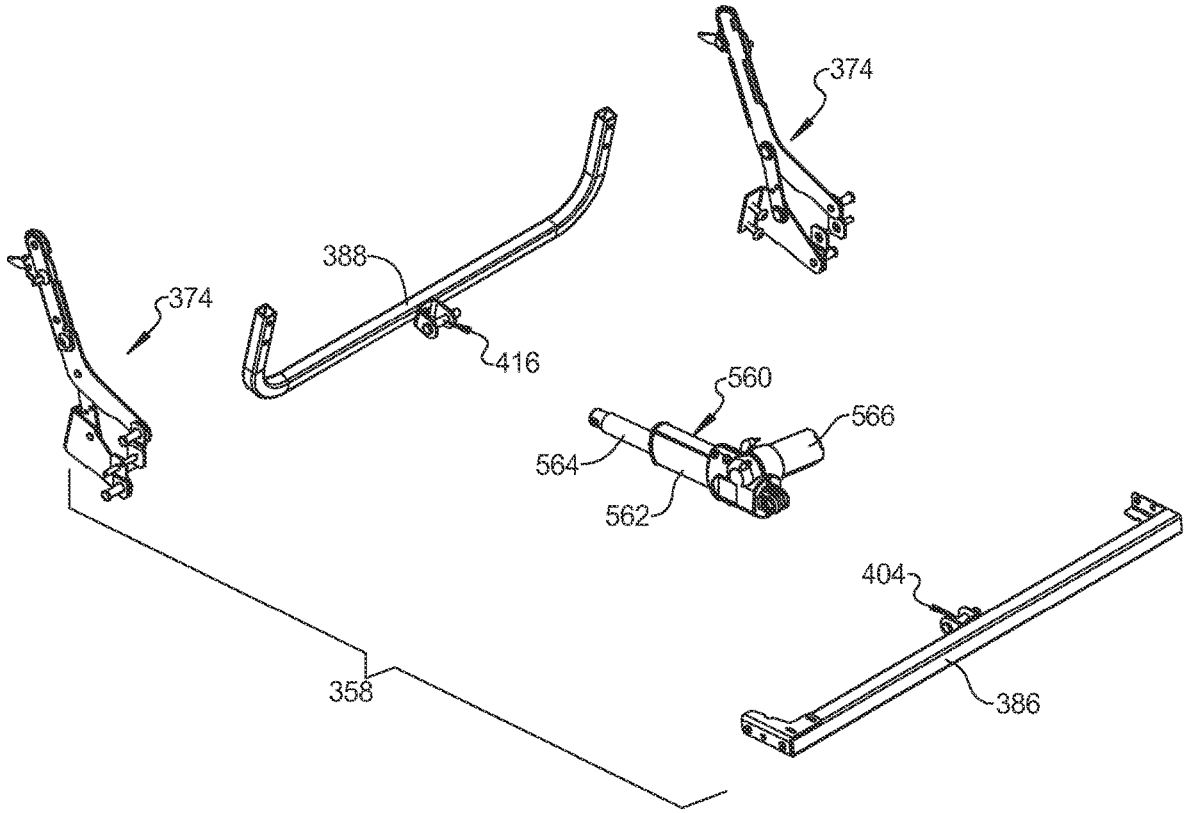
FIG. 21 is a partially exploded view of the reclining mechanism of FIG. 19.
Figure 22:
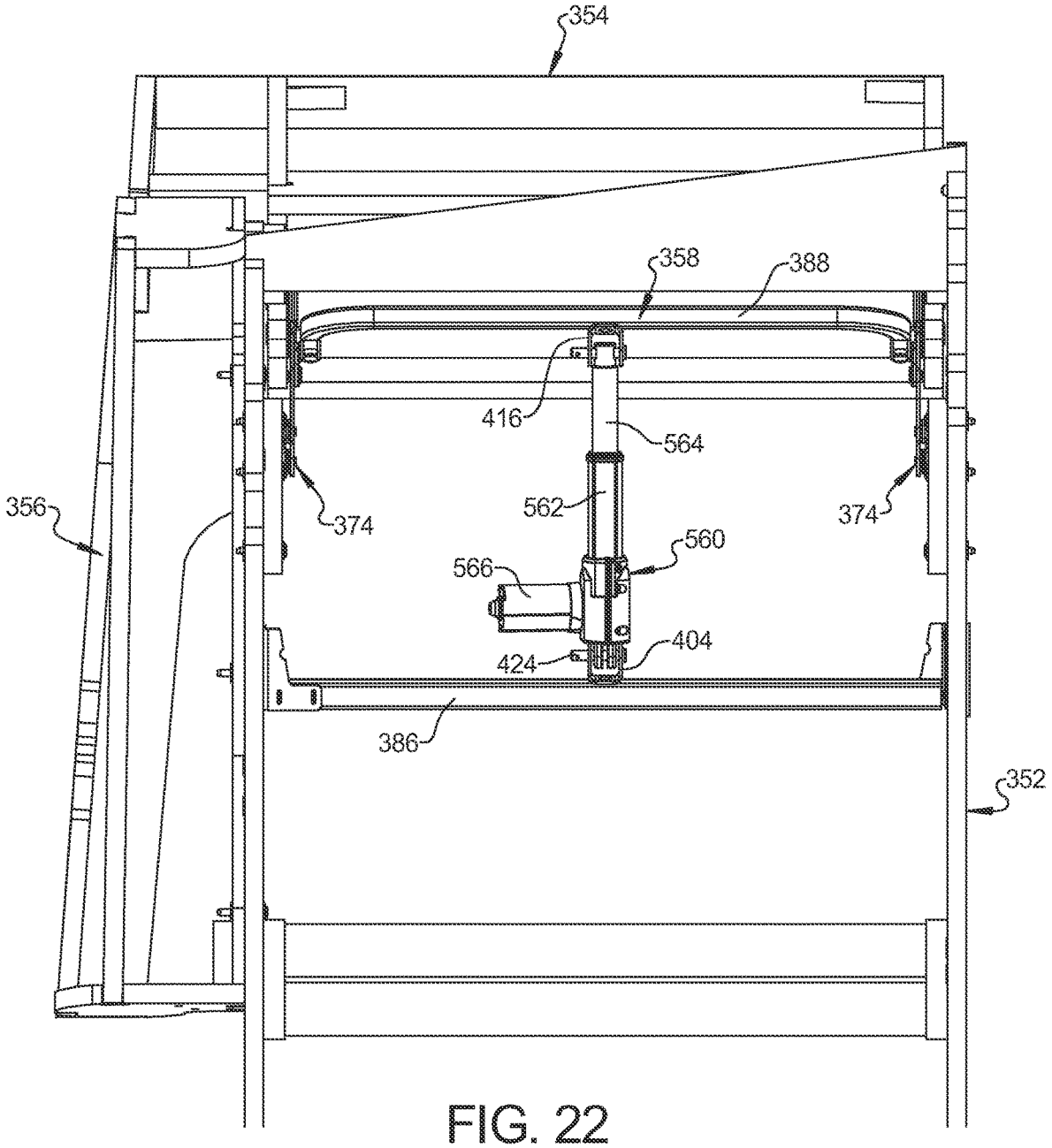
FIG. 22 is an enlarged bottom view of the furniture of FIG. 19 with the seatback frame in the upright position.
Figure 23:
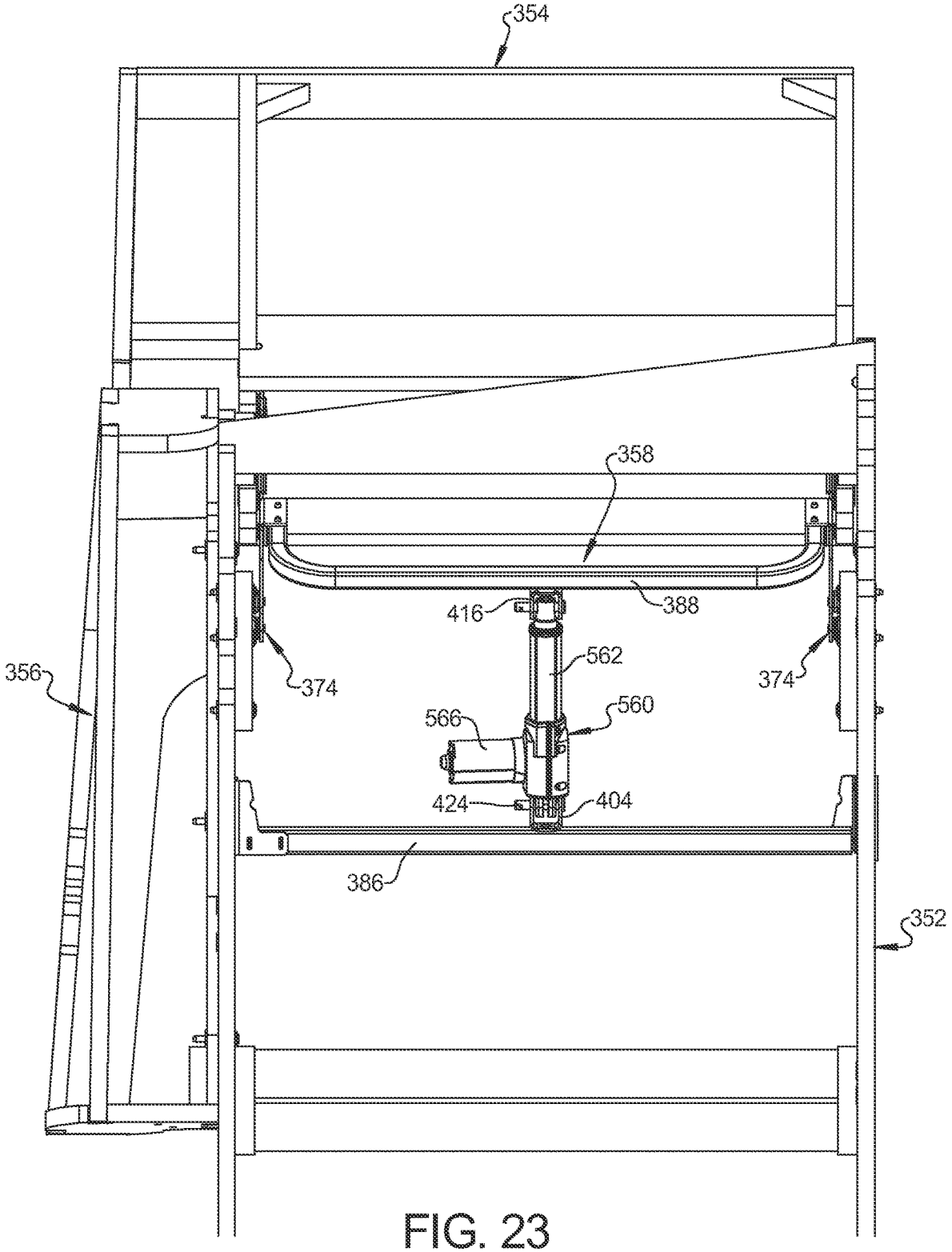
FIG. 23 is an enlarged bottom view of the furniture of FIG. 19 with the seatback frame in the fully reclined position.
Figure 24:
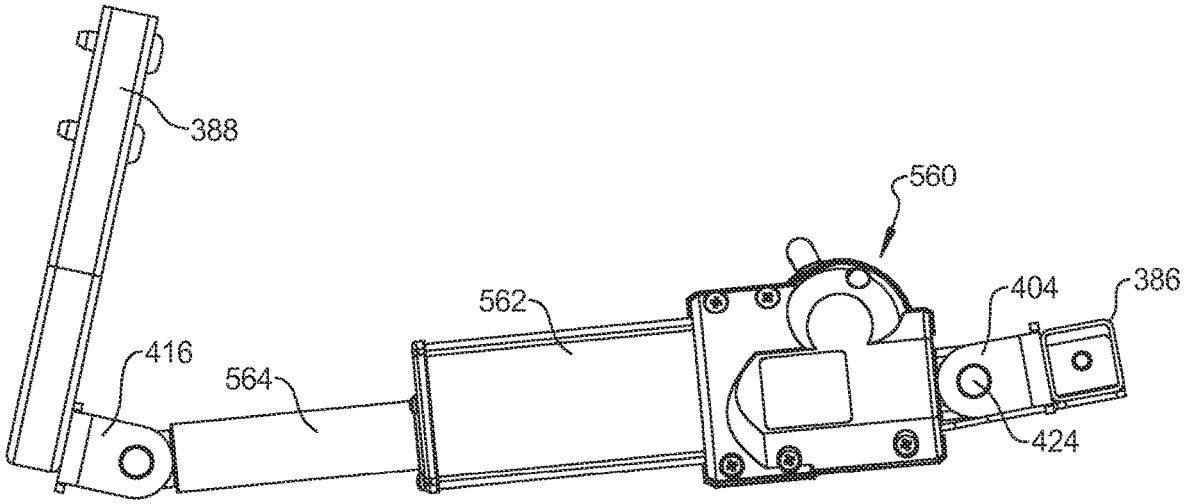
FIG. 24 is a side view of the reclining mechanism of FIG. 19 with a rear support member in a first position and a linear actuator in an extended position.
Figure 25:
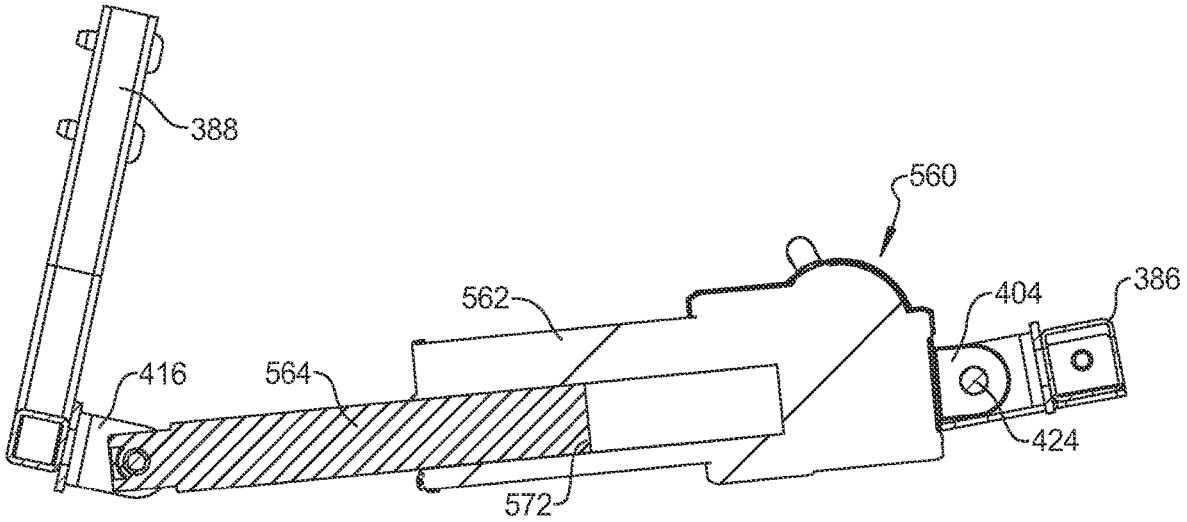
FIG. 25 is a cross-sectional view of the reclining mechanism of FIG. 24 with the rear support member in the first position and the linear actuator in the extended position.
Figure 26:
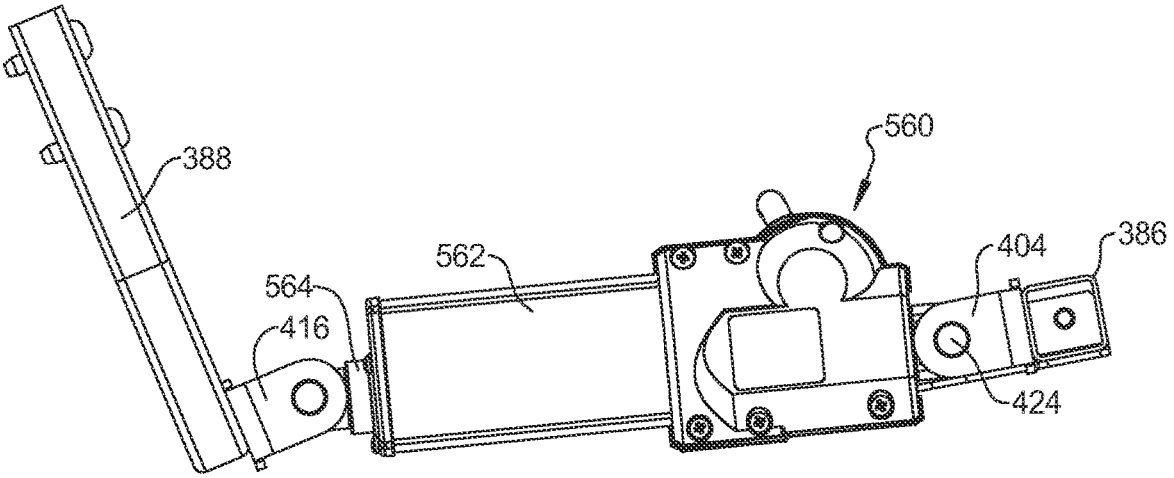
FIG. 26 is a side view of the reclining mechanism of FIG. 20 with the rear support member in a second position and the linear actuator in a retracted position.
Figure 27:
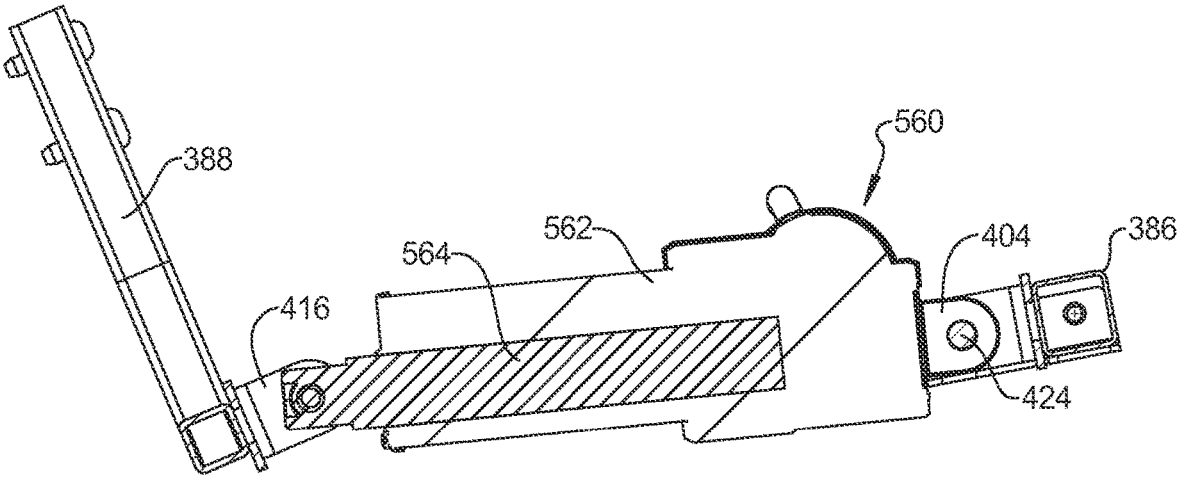
FIG. 27 is a cross-sectional view of the reclining mechanism of FIG. 26 with the rear support member in the second position and the linear actuator in the retracted position.

As shown in FIGS. 21-23, the reclining mechanism 358 may include a front support member 386 with a first clevis 404, a rear support member 388 with a second clevis 416, a pair of linkages 374, and a motor-driven linear actuator 560. The structure and function of the front support member 386, rear support member 388, and linkages 374 may be similar or identical to that of the front support member 86, rear support member 88, and linkages 74 described above. While the furniture member 50 depicted in FIGS. 1-18 is manually driven, the furniture member 350 of FIGS. 19-27 is driven by the linear actuator 560 (i.e., the linear actuator 560 drives the seatback frame 354 between the upright and fully reclined positions. Furthermore, the furniture member 350 may not include the release mechanism 90 or the gas spring 94.

The linear actuator 560 may include a first arm 562, a second arm 564, and a motor 566. The second arm 564 may be partially received within the first arm 562 and may be movable relative to the first arm 562 in a telescoping manner. The first arm 562 may be rotatably coupled to the front support member 386 via the first clevis 404 and clevis pin 424. The second arm 564 may be rotatably coupled to the rear support member 388 via the second clevis 416 and clevis pin 424.

The motor 566 may be mounted to the first arm 562. The motor 566 may drivingly engage the second arm 564 to move the second arm 564 relative to the first arm 562. The user may operate the motor 566 via a user interface (not shown) that may include switches, buttons, knobs, etc. to control movement of the seatback frame 354 relative to the seat bottom frame 352 between the upright position (FIGS. 19 and 22) and the fully reclined position (FIGS. 20 and 23). That is, the linear actuator 560 may move between an extended position (FIGS. 24 and 25) corresponding to the upright position and a retracted position (FIG. 26 to 27) corresponding to the fully reclined position. When the seatback frame 354 is in the upright position, the linear actuator 560 is in the extended position. As the seatback frame 354 moves to the fully reclined position, the second arm 564 of the linear actuator 560 slides further into the first arm 562 toward the retracted position.

In some configurations, the components of the furniture member 50 are identical to the components of the furniture member 350, except that the gas spring 94, release mechanism 90, and cable 92 of furniture member 50 can be replaced with the linear actuator 560 to make the powered furniture member 350. Use of common components between the furniture members 50, 350 has the benefit of reducing complexity and cost.

The shape and positioning of the rear support member 88, 388 helps to improve side-to-side rigidity and reduce shaking and vibration in the furniture member 50, 350 as the seatback frame 54 moves relative to the seat bottom frame 52 between the upright and fully reclined positions. Furthermore, attaching the gas spring 94 or the linear actuator 560 to the front and rear support members 86, 386, 88, 388 at positions that are centered along the lengths (i.e., centered between opposing ends) of the front and rear support members 86, 386, 88, 388 also helps to reduce shaking and vibration in the furniture member 50, 350 as the seatback frame 54, 354 moves relative to the seat bottom frame 52, 352.

The rear support member 88, 388 also acts as a lever arm that helps to support the weight of the seatback frame 54, 354 and the force of the occupant's body resting against the seatback frame 54, 354.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a seat bottom frame;

a seatback frame movable relative to the seat bottom frame among a plurality of positions including an upright position and a fully reclined position; and a reclining mechanism including a front support member, a rear support member, and a pair of linkages, wherein the seatback frame is coupled to the seat bottom frame by the pair of linkages;

wherein the front support member is attached to the seat bottom frame and the rear support member is attached to the pair of linkages, wherein the rear support member is movable relative to the seat bottom frame between a first position and a second position, wherein movement of the seatback frame between the upright position and the fully reclined position causes corresponding and simultaneous movement of the rear support member and the linkages such that the rear support member is moved into the first position when the seatback frame is moved into the upright position and the rear support member is moved into the second position when the seatback frame is moved into the fully reclined position, wherein each of the linkages includes a first link, a second link, and a third link coupled together to move the seatback frame between the upright position and the fully reclined position, wherein the rear support member is fixedly attached to the third link of each of the linkages, and wherein the rear support member and the third links are rotatable relative to the first and second links.

2. The furniture member of claim 1, wherein the rear support member is U-shaped.

3. The furniture member of claim 1, wherein the rear support member is fixedly attached at one end to the third link of one of the linkages and fixedly attached at another end to the third link of another one of the linkages.

4. The furniture member of claim 3, wherein the rear support member and the third link are movable relative to the seat bottom frame and the seatback frame as the seatback frame moves between the upright position and the fully reclined position.

5. The furniture member of claim 4, wherein the first link is non-rotatably attached to the seatback frame and is rotatably attached to the seat bottom frame, and wherein the second link extends between and is rotatably coupled to the first link and the third link.

6. The furniture member of claim 1, wherein the reclining mechanism includes a gas spring that is rotatably attached to the front support member and the rear support member.

7. The furniture member of claim 6, wherein movement of the gas spring controls movement of the rear support member between a plurality of positions including the first and second positions.

8. The furniture member of claim 6, wherein the gas spring urges the rear support member toward the first position to urge the seatback frame toward the upright position.

9. The furniture member of claim 6, wherein the gas spring is in an extended position when the furniture member is in the upright position and the gas spring is in a retracted position when the furniture member is in the fully reclined position.

10. The furniture member of claim 1, wherein the reclining mechanism includes a linear actuator that is rotatably attached to the front support member and the rear support member, and wherein actuation of the linear actuator powers and controls movement of the rear support member between a plurality of positions including the first and second positions.

11. The furniture member of claim 1, wherein the rear support member includes a first end and a second end, and wherein the first and second ends of the rear support member are each attached to the respective ones of the linkages.

12. A furniture member comprising:

a seat bottom frame;

a seatback frame movable relative to the seat bottom frame among a plurality of positions including an upright position and a fully reclined position;

a reclining mechanism including a front support member, a rear support member, a pair of linkages, a gas spring, a release mechanism, and a cable, wherein the gas spring extends between the front and rear support members and the cable extends between the release mechanism and the gas spring, wherein the seatback frame is coupled to the seat bottom frame by the pair of linkages;

the front support member is fixedly attached to the seat bottom frame and the rear support member attached to the pair of linkages; and the rear support member is movable relative to the seat bottom frame and the seatback frame between a first position and a second position, wherein movement of the seatback frame between the upright position and the fully reclined position causes corresponding and simultaneous movement of the rear support member such that the rear support member is moved into the first position when the seatback frame is moved into the upright position and the rear support member is moved into the second position when the seatback frame is moved into the fully reclined position, wherein each of the linkages includes a first link, a second link, and a third link coupled together to move the seatback frame between the upright position and the fully reclined position, wherein the rear support member is fixedly attached to the third link of each of the linkages, and wherein the rear support member and the third links are rotatable relative to the first and second links.

13. The furniture member of claim 12, wherein the release mechanism is operable to move between an actuated position and a non-actuated position.

14. The furniture member of claim 13, wherein the release mechanism includes a release lever that is rotatably coupled to a base bracket.

15. The furniture member of claim 12, wherein the gas spring is rotatably attached to the front support member and the rear support member, and wherein movement of the gas spring between an extended position and a retracted position controls movement of the rear support member between a plurality of positions including the first and second positions.

16. The furniture member of claim 15, wherein the gas spring is in the extended position when the furniture member is in the upright position and the gas spring is in the retracted position when the furniture member is in the fully reclined position, and wherein the gas spring urges the rear support member toward the first position to urge the seatback frame toward the upright position.

17. The furniture member of claim 16, wherein the gas spring includes a rod and a tube, and wherein the rod slidably moves within the tube in a telescoping manner to move the gas spring between the retracted position and the extended position.

18. The furniture member of claim 12, wherein the rear support member is U-shaped.

* * * * *